US009604705B1

(12) United States Patent
Stupakis et al.

(10) Patent No.: US 9,604,705 B1
(45) Date of Patent: Mar. 28, 2017

(54) COLLAPSIBLE ANCHOR

(71) Applicants: John S. Stupakis, El Segundo, CA (US); Steve J. Stupakis, El Segundo, CA (US)

(72) Inventors: John S. Stupakis, El Segundo, CA (US); Steve J. Stupakis, El Segundo, CA (US)

( * ) Notice: Subject to any disclaimer, the term of this patent is extended or adjusted under 35 U.S.C. 154(b) by 0 days.

(21) Appl. No.: 15/056,854

(22) Filed: Feb. 29, 2016

(51) Int. Cl.
*B63B 21/26* (2006.01)
*B63B 21/24* (2006.01)

(52) U.S. Cl.
CPC ..... *B63B 21/243* (2013.01); *B63B 21/26* (2013.01)

(58) Field of Classification Search
CPC ..... B63B 21/243; B63B 21/44
See application file for complete search history.

(56) References Cited

U.S. PATENT DOCUMENTS 347,972 A * 8/1886 Spedden ..... B63B 21/44 114/303
4,134,355 A * 1/1979 Carruthers ..... B63B 21/38 114/297
4,763,597 A 8/1988 Stupakis
4,958,586 A 9/1990 Stupakis

* cited by examiner

*Primary Examiner* — Edwin Swinehart
(74) *Attorney, Agent, or Firm* — Lewis Roca Rothgerber Christie LLP

(57) ABSTRACT

A collapsible anchor including a first shank, a second shank configured to be detachably coupled to the first shank, and at least one fluke configured to be hingedly coupled to the first and second shanks. The fluke is configured to move between a stowed position and a deployed position. The collapsible anchor also includes a first vane configured to be hingedly coupled to the first shank and a second vane configured to be hingedly coupled to the second shank. The collapsible anchor also includes at least one stop configured to limit rotation of the first and second vanes relative to the first and second shanks. When the first and second vanes and the at least one fluke are hingedly coupled to the first and second shanks, the first vane extends in a first direction and the second vane extends in a second direction different than the first direction.

22 Claims, 15 Drawing Sheets

203,204
224
225
β
d
219
231
223

9C
9C
228
L
225
203,204
224
229
226
231
223
9B
S
9B
230
227
223
μ
231
224
226
θ
225

COLLAPSIBLE ANCHOR

FIELD

The present disclosure relates generally to anchors and, more particularly, to collapsible anchors.

BACKGROUND

A variety of different types of anchors exist to anchor a vessel (e.g., a boat or a ship) to the bed of a body of water. The type of anchor may be selected depending on the composition of the seabed (e.g., sand, rocks, and/or organic material, such as kelp), the size and weight of the vessel, and/or the conditions on the body of water (e.g., wind speed and/or current strength). Some existing types of anchors include Grapnel anchors, Herreshoff anchors, Northill anchors, plough anchors, Danforth anchors, and claw anchors.

However, conventional anchors are not configured to be readily disassembled into their constituent components, such as for transportation or storage. Additionally, many conventional anchors are not configured to collapse into a stowed configuration for ease of transportation and/or storage.

SUMMARY

The present disclosure is directed to various embodiments of a collapsible anchor. In one embodiment, the collapsible anchor includes a first shank, a second shank configured to be detachably coupled to the first shank, and at least one fluke configured to be hingedly coupled to the first and second shanks. The fluke is configured to move between a stowed position and a deployed position. The collapsible anchor also includes a first vane configured to be hingedly coupled to the first shank and a second vane configured to be hingedly coupled to the second shank. When the first and second vanes and the at least one fluke are hingedly coupled to the first and second shanks, the first vane extends in a first direction and the second vane extends in a second direction different than the first direction. The collapsible anchor may include a sleeve configured to couple upper ends of the first and second shanks together. When the first shank is coupled to the second shank, the first and second shanks together may form a wishbone configuration. When the first shank is coupled to the second shank, the first and second shanks together may form a hinge.

The collapsible anchor may include a first stock connected to the first vane and configured to rotatably couple the first vane to the first shank and a second stock connected to the second vane and configured to rotatably couple the second vane to the second shank. When the first and second vanes are rotatably coupled to the first and second shanks by the first and second stocks, the first stock may extend out from the first shank and the second stock may extend out from the first shank. The collapsible anchor may include a first bifurcated flange connected to the first vane and configured to detachably couple the first vane to the fluke and a second bifurcated flange connected to the second vane and configured to detachably couple the second vane to the fluke. The fluke may include a connection member and the collapsible anchor may include a first enlarged segment defining a first channel connected to the first vane and a second enlarged segment defining a second channel connected to the second vane. The first and second channels are configured to receive portions of the connection member to couple the first and second vanes to the at least one fluke. A lower end of each of the first and second shanks may include a return flange. The return flanges on the first and second shanks are configured to engage respective ones of the first and second vanes to limit rotation of the first and second vanes relative to the first and second shanks.

The collapsible anchor may include first and second flukes, a first support member fixedly coupling the first fluke to the first vane, and a second support member fixedly coupling the second fluke to the second vane. When the first and second shanks are coupled together, the first and second shanks together may define a keyhole opening configured to receive a portion of each of the first and second support members. The keyhole opening defined by the first and second shanks may include an arcuate portion having an angle from approximately 50 degrees to approximately 90 degrees. The collapsible anchor may include a stop mechanism including a stop. When the first and second vanes are pivotably coupled to the first and second shanks, the stop extends into the arcuate portion of the keyhole opening and is configured to engage ends of the arcuate portion of the keyhole opening to limit rotation of the first and second vanes relative to the first and second shanks.

The first support member may define a first semi-annular notch and the second support member may define a corresponding second semi-annular notch such that the first support member is configured to matedly engage the second support member. The first and second support members may each include a pair of spaced apart semi-annular ribs. The semi-annular ribs are configured to engage the first and second shanks to prevent lateral movement of the first and second vanes and the first and second flukes relative to the first and second shanks. The collapsible anchor may include an anchor shackle configured to couple upper ends of the first and second shanks together.

This summary is provided to introduce a selection of features and concepts of embodiments of the present disclosure that are further described below in the detailed description. This summary is not intended to identify key or essential features of the claimed subject matter, nor is it intended to be used in limiting the scope of the claimed subject matter. One or more of the described features may be combined with one or more other described features to provide a workable device.

BRIEF DESCRIPTION OF THE DRAWINGS

The features and advantages of embodiments of the present disclosure will become more apparent by reference to the following detailed description when considered in conjunction with the following drawings. In the drawings, like reference numerals are used throughout the figures to reference like features and components. The figures are not necessarily drawn to scale.

DETAILED DESCRIPTION

The present disclosure is directed to various embodiments of a collapsible anchor. Additionally, in one or more embodiments, the collapsible anchors of the present disclosure are configured to be readily disassembled into its constituent components and readily reassembled. Additionally, in one or more embodiments, the collapsible anchors of the present disclosure are configured to move between a deployed position and a stowed position, which facilitates ease of transportation and/or storage of the collapsible anchors.

Figure 1B:
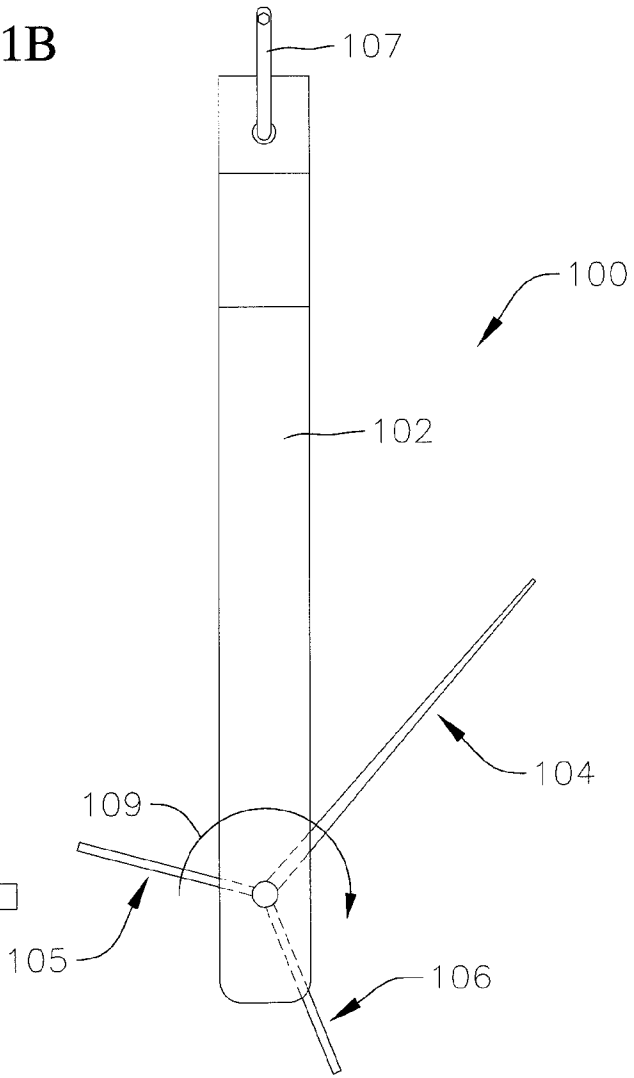
FIGS. 1A-1B are a rear view and a side view, respectively, of a collapsible anchor according to one embodiment of the present disclosure.
Figure 1A:
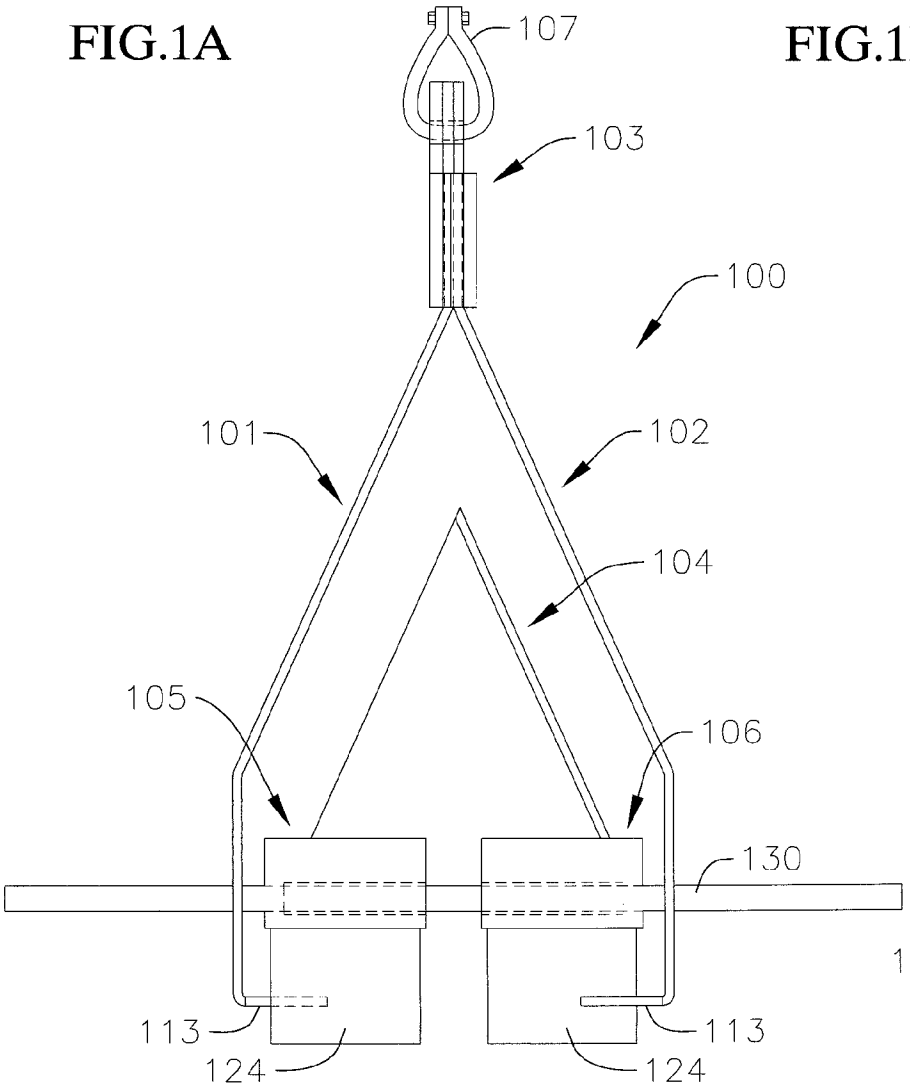

With reference now to FIGS. 1A-1B, a collapsible anchor 100 according to one embodiment of the present disclosure includes a pair of shanks 101, 102 configured to be detachably coupled together, a sleeve or collar 103 configured to couple the shanks 101, 102 together, a fluke 104 pivotally coupled to the shanks 101, 102, and a pair of vane assemblies 105, 106 coupled to the fluke 104 and pivotally coupled to the shanks, respectively. Additionally, in the illustrated embodiment, the collapsible anchor 100 includes an anchor shackle 107 coupled to the sleeve 103 and the shanks 101, 102 and an anchor line 108 (e.g., an anchor chain) (see FIG. 6) coupled to the anchor shackle 107 and configured to couple the collapsible anchor 100 to a sea vessel (e.g., a ship or a boat).

In the illustrated embodiment, the fluke 104 and the pair of vane assemblies 105, 106 are configured to rotate or pivot (arrow 109) relative to the pair of shanks 101, 102 between a stowed position (see FIG. 1A) and a deployed position (see FIG. 1B). In the stowed position, the fluke 104 is located between the shanks 101, 102 and in the deployed position at least a portion of the fluke 104 projects or extends out away from the shanks 101, 102.

Figure 2A:
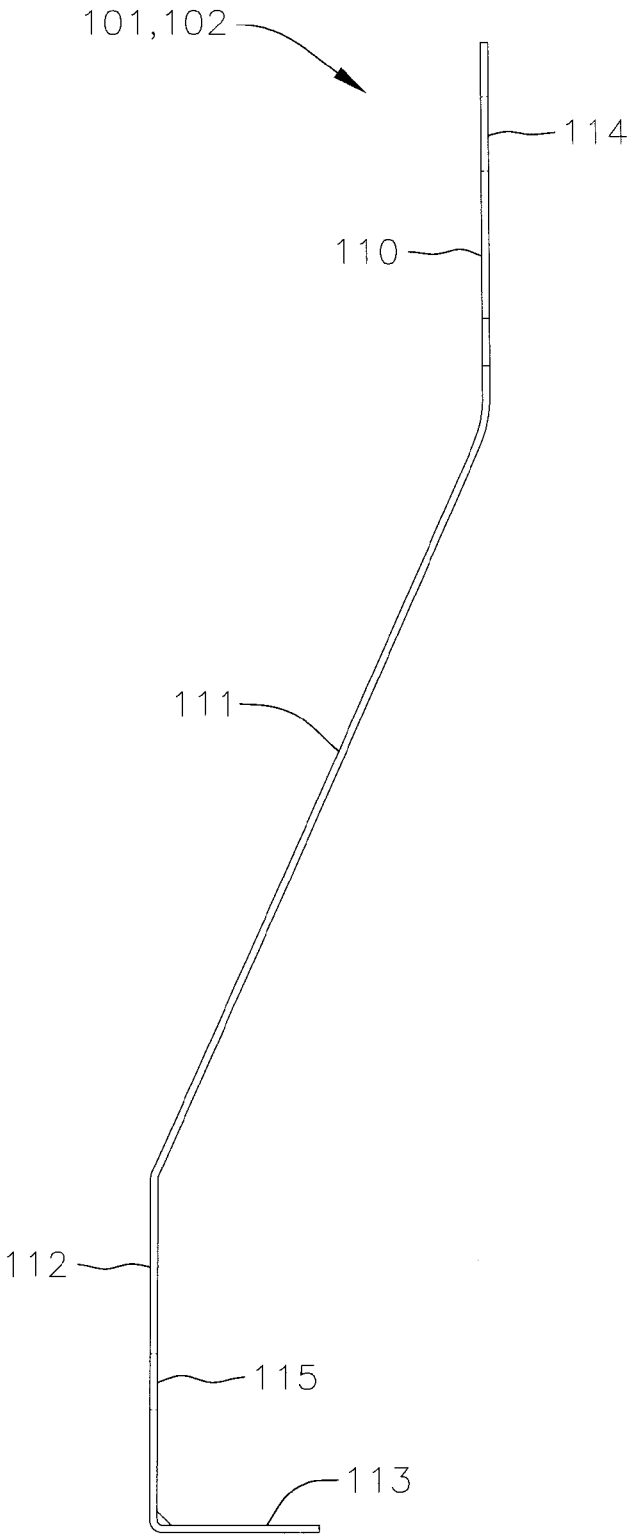
FIGS. 2A-2B are a rear view and a side view, respectively, of a shank of the collapsible anchor according to one embodiment of the present disclosure.
Figure 2B:
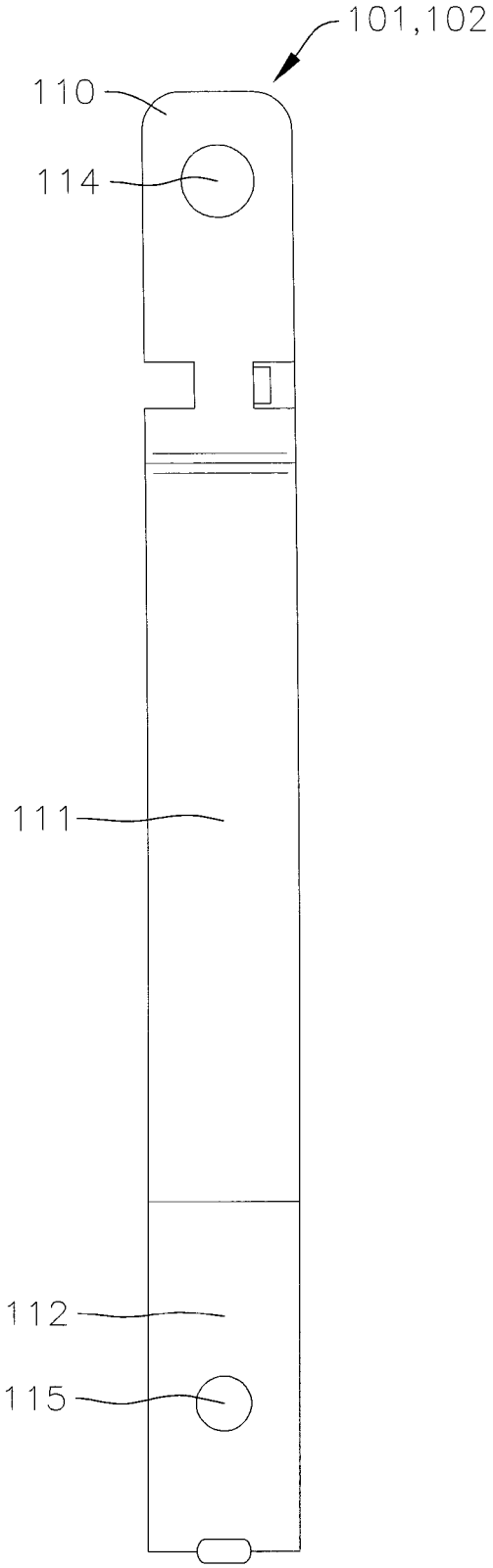

With reference now to the embodiment illustrated in FIGS. 2A-2B, each of the shanks 101, 102 includes an upper segment 110, a canted segment 111 extending downward and outward from a lower end of the upper segment 110, a lower segment 112 extending down from the canted segment 111, and an inner segment 113 (e.g., a return flange) extending inward from a lower end of the lower segment 112. The shanks 101, 102 are configured to be detachably coupled to each other. When the shanks 101, 102 are coupled together, the upper segment 110 of one of the shanks 101 engages or contacts the upper segment 110 of the other shank 102. Together, the shanks 101, 102 define a wishbone configuration in the illustrated embodiment. Additionally, in the illustrated embodiment, the upper segment 110 of each of the shanks 101, 102 defines an opening 114 (e.g., a hole) and the lower segment 112 of each of the shanks 101, 102 defines an opening 115 (e.g., a hole), the significance of which is described below. Although in one or more embodiments the segments 110, 111, 112, 113 may be integrally formed by any suitable manufacturing process or technique (e.g., bending or milling), in one or more embodiments, one or more of the segments 110, 111, 112, 113 may be separately formed and then coupled together by any suitable manufacturing process or technique, such as, for instance, welding.

Figure 3A:
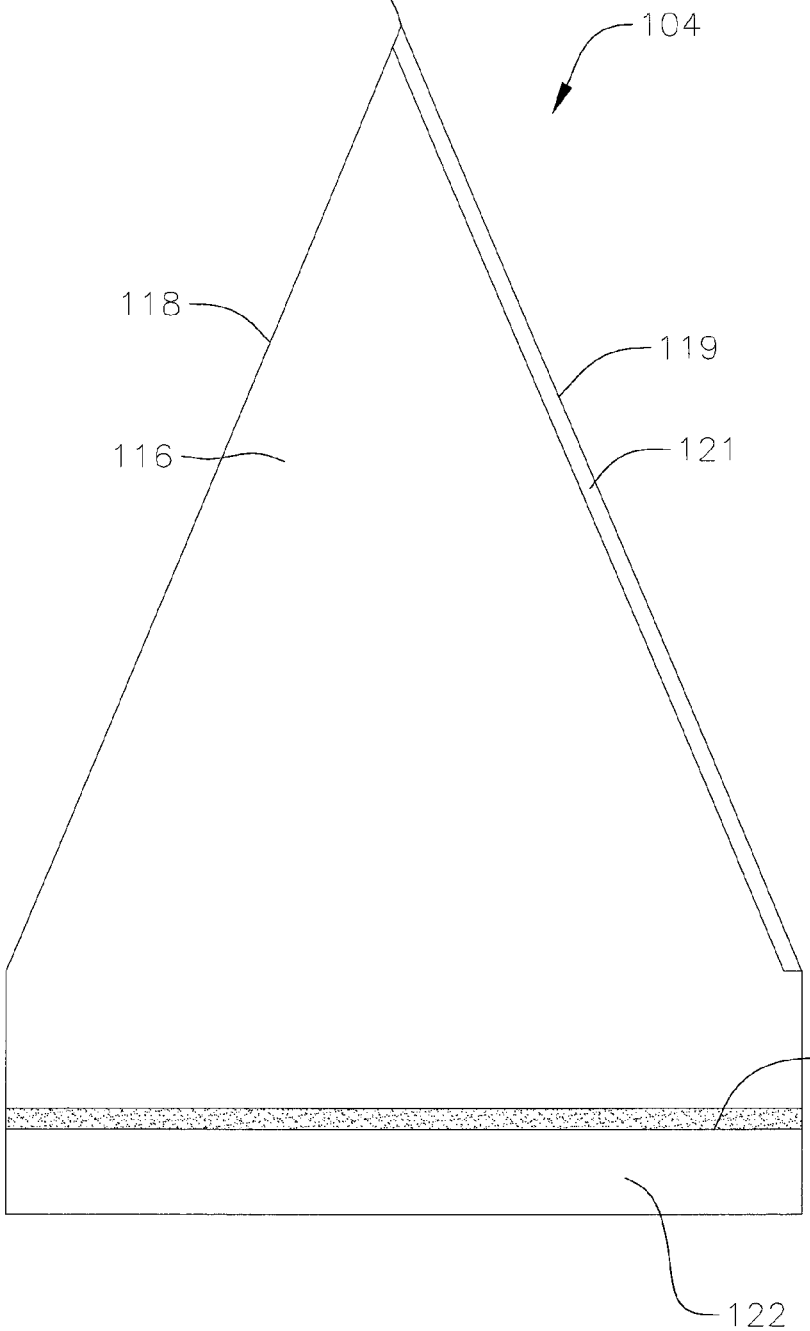
FIGS. 3A-3B are a rear view and a side view, respectively, of a fluke of the collapsible anchor according to one embodiment of the present disclosure.
Figure 3B:
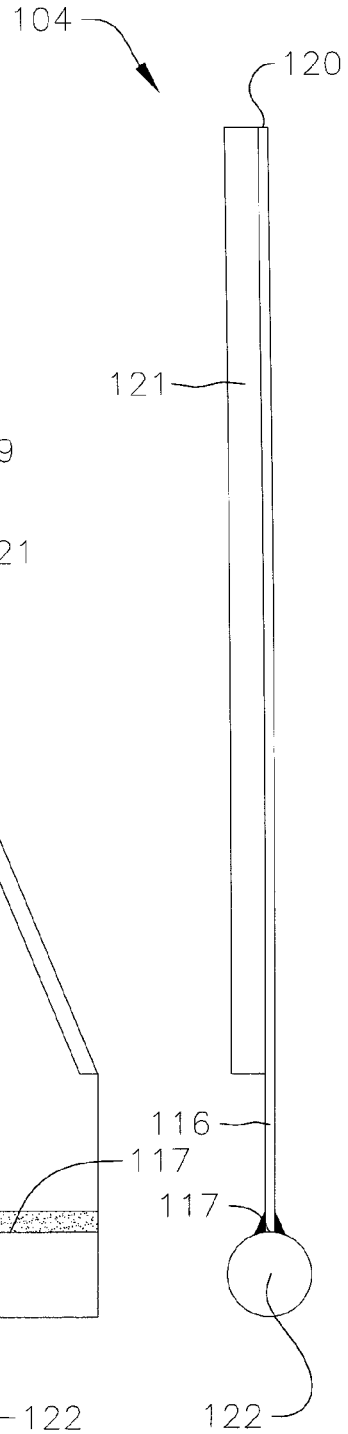

With reference now to the embodiment illustrated in FIGS. 3A-3B, the fluke 104 includes a triangular base plate 116 having a base edge 117 and a pair of tapered edges 118, 119. In the illustrated embodiment, the tapered edges 118, 119 of the triangular base plate 116 terminate at a tip or a bill 120 of the fluke 104. Additionally, in one or more embodiments, the fluke 104 may include one or more stiffening members 121 (e.g., one or more ribs) on the base plate 116 that are configured to strengthen the base plate 116. In one or more embodiments, the base plate 116 of the fluke 104 may have any other shape suitable for type or kind of materials that the fluke 104 is configured to engage on the seabed (e.g., sand, rocks, and/or organic material). The one or more stiffening members 121 may be integrally formed with the base plate 116 of the fluke 104 or formed separately and then connected to the base plate 116 of the fluke by any suitable manufacturing process or technique (e.g., welding and/or fastening). Additionally, in the illustrated embodiment, the fluke 104 includes a connection member 122 extending along at least a portion of the base edge 117 of the base plate 116. Although in the illustrated embodiment the connection member 122 is cylindrical (i.e., a circular cross-section), in one or more embodiments the connection member 122 may have any other suitable shape, such as, for instance, a prismatic shape (e.g., a square prism having a square cross-sectional shape).

Figures 4A, 4B, 4C:
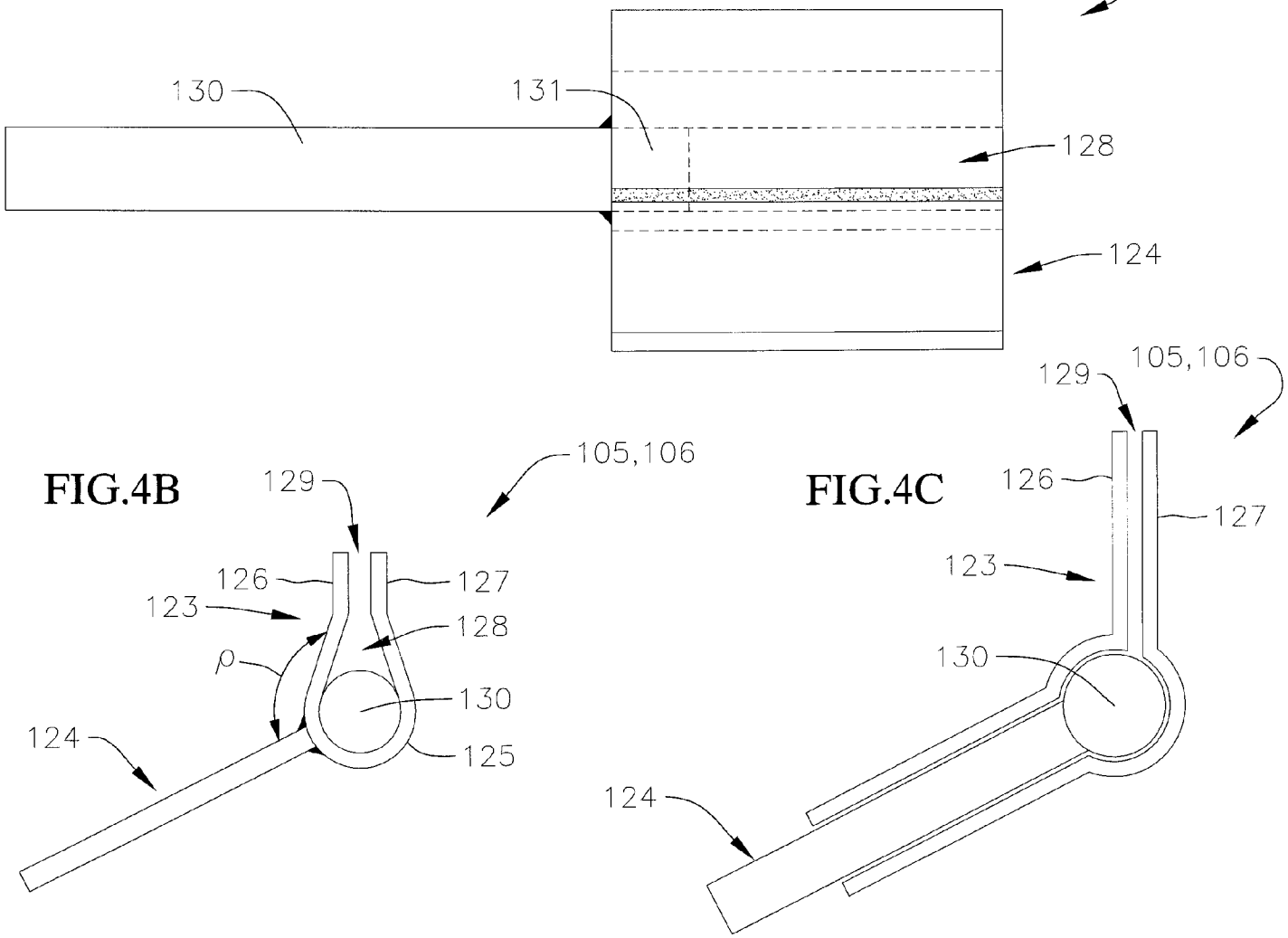
FIGS. 4A-4B are a rear view and a side view, respectively, of a vane assembly of the collapsible anchor according to one embodiment of the present disclosure.
FIG. 4C is a side view of a vane assembly according to another embodiment of the present disclosure.

With reference now to the embodiment illustrated in FIGS. 4A-4B, each of the vane assemblies 105, 106 includes an upper blade 123 and a lower blade or vane 124 extending from a lower end of the upper blade 123. In the illustrated embodiment, the upper blade and the vane 123, 124 are oriented such that an obtuse angle $\rho$ is defined between the upper blade and the vane 123, 124. In one or more embodiments, the upper blade and the vane 123, 124 may have any other suitable orientation (e.g., an acute angle may be defined between the upper blade and the vane 123, 124). Additionally, in the illustrated embodiment, the upper blade 123 includes an enlarged segment 125 at the lower end of the upper blade 123 and a bifurcated flange having a pair of arms 126, 127 extending up from the enlarged segment 125. In the illustrated embodiment, the enlarged segment 125 of the upper blade 123 is rounded (i.e., curved), although in one or more embodiments the enlarged segment 125 of the upper blade 123 may have any other suitable shape, depending, for instance, on the shape of the connection member 122 of the fluke 104. Additionally, in the illustrated embodiment, the enlarged segment 125 of the upper blade 123 defines a channel 128 extending along the length of the upper blade 123. Additionally, in the illustrated embodiment, a slot 129 is defined between the arms 126, 127 of the bifurcated flange. The slot 129 defined between the arms 126, 127 of the bifurcated flange extends along the length of the upper blade 123.

In the illustrated embodiment, each of the vane assemblies 105, 106 also includes a stock 130. In the illustrated embodiment, an inner end 131 of the stock 130 is received in an outer portion of the channel 128 defined in the upper blade 123 and a remainder of the stock 130 projects outward from the upper blade 123 and the vane 124 (i.e., the stock 130 does not completely occupy the channel 128 defined in the upper blade 123 such that a portion of the channel 128 remains open, the significance of which is described below). In the illustrated embodiment, the stock 130 is a cylindrical rod (i.e., the stock 130 is a tubular member that has a circular cross-sectional shape). In the illustrated embodiment, the stocks 130 of the vane assemblies 105, 106 are configured to extend through the openings 115 in the lower segments 112 of the shanks 101, 102 to rotatably couple the vane assemblies 105, 106 to the shanks 101, 102, respectively. Additionally, in the illustrated embodiment, the stocks 130 of the vane assemblies 105, 106 extend or project out from the lower segments 112 of the shanks 101, 102, respectively.

Additionally, in the illustrated embodiment, outer ends of the connection member 122 of the fluke 104 are received in inner portions of the channels 128 defined in the vane assemblies 105, 106 to couple the vane assemblies 105, 106 to the fluke 104 (e.g., the channels 128 defined in the vane assemblies 105, 106 may be slid onto the connection member 122 of the fluke 104). When the connection member 122 of the fluke 104 is received in the channels 128 defined in the vane assemblies 105, 106, a lower end of the base plate 116 of the fluke 104 is received in the slots 129 defined in the vane assemblies 105, 106 such that the arms 126, 127 of the bifurcated flange of each vane assembly 105, 106 are disposed on opposite sides of the base plate 116 of the fluke 104. The engagement between the arms 126, 127 of the vane assemblies 105, 106 and the base plate 116 of the fluke 104 couples the vane assemblies 105, 106 to the fluke 104 and rotatably constrains the vane assemblies 105, 106 to the fluke 104 such that the vane assemblies 105, 106 and the fluke 104 are configured to rotate (arrow 109) together relative to the shanks 101, 102 (e.g. the vane assemblies 105, 106 and the fluke 104 are configured to rotate (arrow 109) synchronously or simultaneously relative to the shanks 101, 102). Furthermore, when the vane assemblies 105, 106 are coupled to the fluke 104, the vanes 124 of the vane assemblies 105, 106 are located on opposite sides of the return flanges 113 of the shanks 101, 102. For instance, in the embodiment illustrated in FIG. 1A, the vane 124 of the left vane assembly 105 is located behind the return flange 113 on the left shank 101 and the vane 124 of the right vane assembly 106 is located in front of the return flange 113 on the right shank 102. As described in more detail below, the return flanges 113 are configured to engage the vanes 124 to limit rotation (arrow 109) of the fluke 104 and the vane assemblies 105, 106 relative to the shanks 101, 102. Additionally, due to the positioning of one of the vanes 124 behind one of the return flanges 113 and the other vane 124 in front of the other return flange 113, one of the return flanges 113 is configured to engage one of the vanes 124 when the fluke 104 and the vane assemblies 105, 106 rotate in a first direction and the other return flange 113 is configured to engage the other vane 124 when the fluke 104 and the vane assemblies 105, 106 rotate in a second direction opposite the first direction.

FIG. 4C illustrates an alternate embodiment of the vane assemblies 105, 106. Unlike the embodiment of the vane assemblies 105, 105 illustrated in FIG. 4B in which the upper blade 123 is a single component extending around the stock 130 (i.e., the upper blade 123 includes the enlarged segment 125 partially extending around the stock 130 and the pair of arms 126, 127 extending up from the enlarged segment 125 to form the bifurcated flange), the upper blade 123 in the embodiment of the vane assemblies 105, 106 illustrated in FIG. 4C includes two separate components coupled to the stock 130 and/or to the vane 124 by any suitable process (e.g., welding) to form the arms 126, 127 of the bifurcated flange.

Figure 5A:
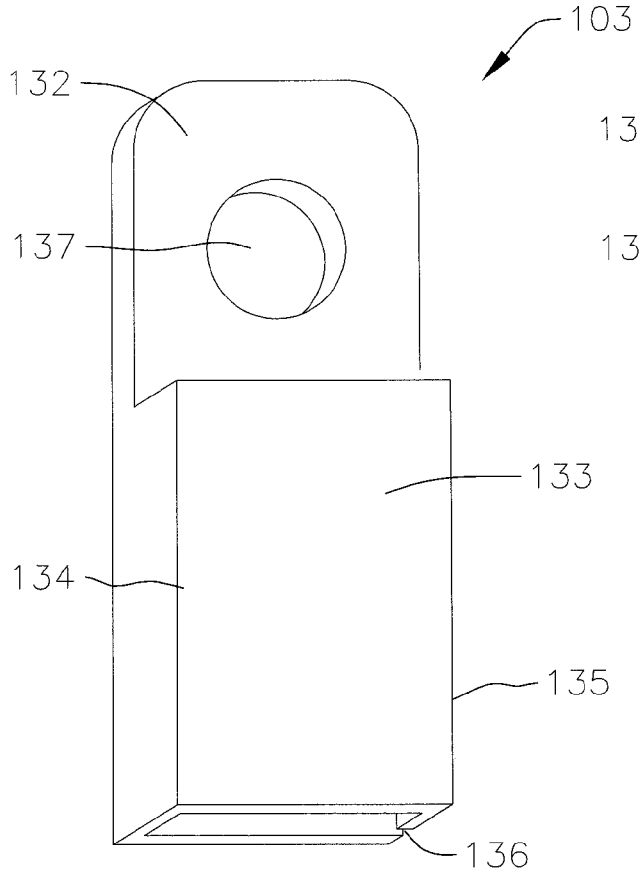
FIGS. 5A-5C are a perspective view, a rear view, and a top view, respectively, of a sleeve of the collapsible anchor according to one embodiment of the present disclosure.
Figure 5B:
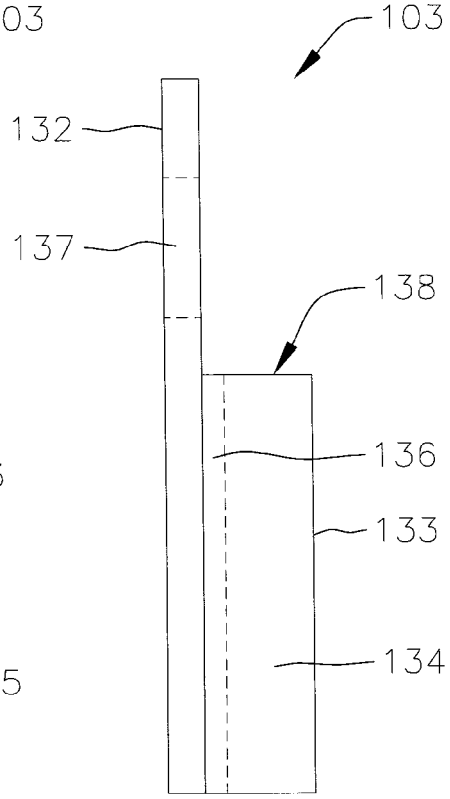
Figure 5C:
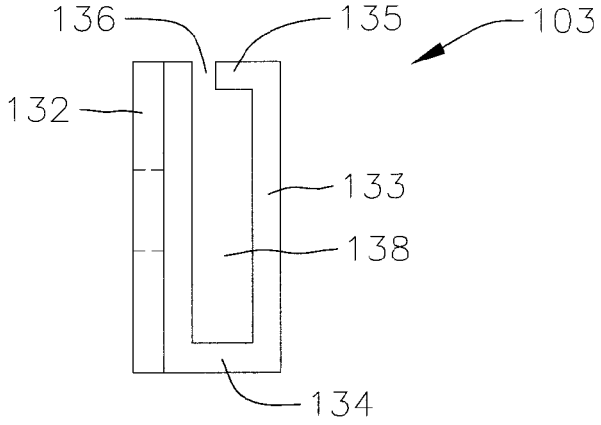

With reference now to the embodiment illustrated in FIGS. 5A-5C, the sleeve 103 is configured to couple the shanks 101, 102 together and to enable the shanks 101, 102 to be readily detached from each other. In the illustrated embodiment, the sleeve 103 is sized to extend down to the junction between the upper segments 110 and the canted segments 111 of the shanks 101, 102 (e.g., the sleeve 103 is configured to extend along the entire length or substantially the entire length of the upper segments 110 of the shanks 101, 102). In one or more embodiments, the sleeve 103 may have any other suitable size such that the sleeve 103 is configured to extend along any other suitable portion of the upper segments 110 of the shanks 101, 102, such as, for instance, approximately 1/5 the length of the upper segments 110 or more. In the illustrated embodiment, the sleeve 103 includes a rear wall 132, a front wall 133 spaced apart from the rear wall 132, and a pair of side walls 134, 135 extending from opposite sides of the front wall 133 toward the rear wall 132. In the illustrated embodiment, one of the side walls 134 extends completely to the rear wall 132 and the other side wall 135 is spaced apart rear wall 132 by a gap 136 (i.e., one of the side walls 135 does not extend completely to the rear wall 132). Additionally, in the illustrated embodiment, the front wall 133 and the side walls 134, 135 are shorter than the rear wall 132 and a portion of the rear wall 132 extends above the front wall 133 and the side walls 134, 135. In the illustrated embodiment, the rear wall 132 defines an opening 137 (e.g., a hole) above the front and side walls 133, 134, 135. Together, the rear wall 132, the front wall 133, and the side walls 134, 135 define a cavity 138 having open upper and lower ends. In one or more embodiments, the sleeve 103 may have any other suitable shape and/or configured suitable for detachably coupling the shanks 101, 102 together. Additionally, in one or more embodiments, the collapsible anchor 100 may be provided without the sleeve 103 and the shanks 101, 102 may be detachably coupled together by any other suitable mechanism, such as, for instance, with one or more fasteners or with the anchor shackle 107.

To assemble the collapsible anchor 100, the vane assemblies 105, 106 may be coupled to the fluke 104 by sliding the channels 128 defined in the vane assemblies 105, 106 onto the connection member 122 of the fluke 104 (e.g., opposite ends of the connection member 122 may be slid into the open portion of each of the channels 128 that is not occupied by the stocks 130) and sliding the slots 129 defined in the vane assemblies 105, 106 onto the lower end of the base plate 116 of the fluke 104 such that the arms 126, 127 of the bifurcated flange of each vane assembly 105, 106 are disposed on opposite sides of the base plate 116 of the fluke 104. The fluke 104 and the vane assemblies 105, 106 may be rotatably coupled to the shanks 101, 102 by sliding the stocks 130 through the openings 115 in the lower segments 112 of the shanks 101, 102. The shanks 101, 102 may be coupled together by placing the upper segments 110 of the shanks 101, 102 against each other and sliding the sleeve 103 down over the upper segments 110 of the shanks 101, 102 such that the upper segments 110 of the shanks 101, 102 extend up through the cavity 138 defined in the sleeve 103. Additionally, the sleeve 103 may be slid down along the upper segments 110 of the shanks 101, 102 until the opening 137 defined in the rear wall 132 of the sleeve 103 is aligned with the openings 114 defined in the upper segments 110 of the shanks 101, 102. In the illustrated embodiment, when the opening 137 in the sleeve 103 is aligned with the openings 114 in the shanks 101, 102, the sleeve 103 (or at least a portion thereof) extends along the entire length or substantially the entire length of the upper segments 110 of the shanks 101, 102 such that a lower end of the sleeve 103 is proximate the junction between the upper segments 110 and the canted segments 111 of the shanks 101, 102. Although in the illustrated embodiment only the rear wall 132 of the sleeve 103 extends along the entire length of the upper segments 111 of the shanks 101, 102, in one or more embodiments, each of the walls 132, 133, 134, 135 of the sleeve 103 may extend along the entire length of the upper segments 111 of the shanks 101, 102 such that the sleeve 103 extends entirely along and around the upper segments 111 of the shanks 101, 102. The engagement between the sleeve 103 and the upper segments 111 of the shanks 101, 102 is configured to restrict or constrain all degrees of freedom of the shanks 101 to maintain the integrity of the anchor 100 when assembled. The shanks 101, 102 and the sleeve 103 may then be coupled together by inserting the shackle 107 through the aligned openings 114, 137 in the shanks 101, 102 and the sleeve 103, as illustrated in FIGS. 1A-1B. The shackle 107 may be coupled to one end of the anchor line 108 (e.g., an anchor chain) (see FIG. 6) and an opposite end of the anchor line 108 may be coupled to a sea vessel (e.g., a ship or a boat) that is intended to be anchored by the collapsible anchor 100.

To disassemble the collapsible anchor 100 (e.g., for storage and/or transportation), the shanks 101, 102 may be detached from each other by removing the anchor shackle 107 from the openings 114, 137 in the shanks 101, 102 and the sleeve 103 and sliding the sleeve 103 up off of the upper segments 110 of the shanks 101, 102 such that the upper segments 110 of the shanks 101, 102 are withdrawn through the cavity 138 defined in the sleeve 103. The vane assemblies 105, 106 may be detached from the shanks 101, 102 by sliding the stocks 130 out of the openings 115 in the lower segments 112 of the shanks 101, 102 (e.g., withdrawing the stocks 130 from the openings 115 in the shanks 101, 102) by moving the shanks 101, 102 away from each other. The vane assemblies 105, 106 may be detached from the fluke 104 by sliding the vane assemblies 105, 106 outward along the connection member 122 of the fluke 104 such that the connection member 122 is withdrawn from the channels 128 defined in the vane assemblies 105, 106 and the lower end of the base plate 116 is withdrawn from the slots 129 defined in the vane assemblies 105, 106.

Figure 6:
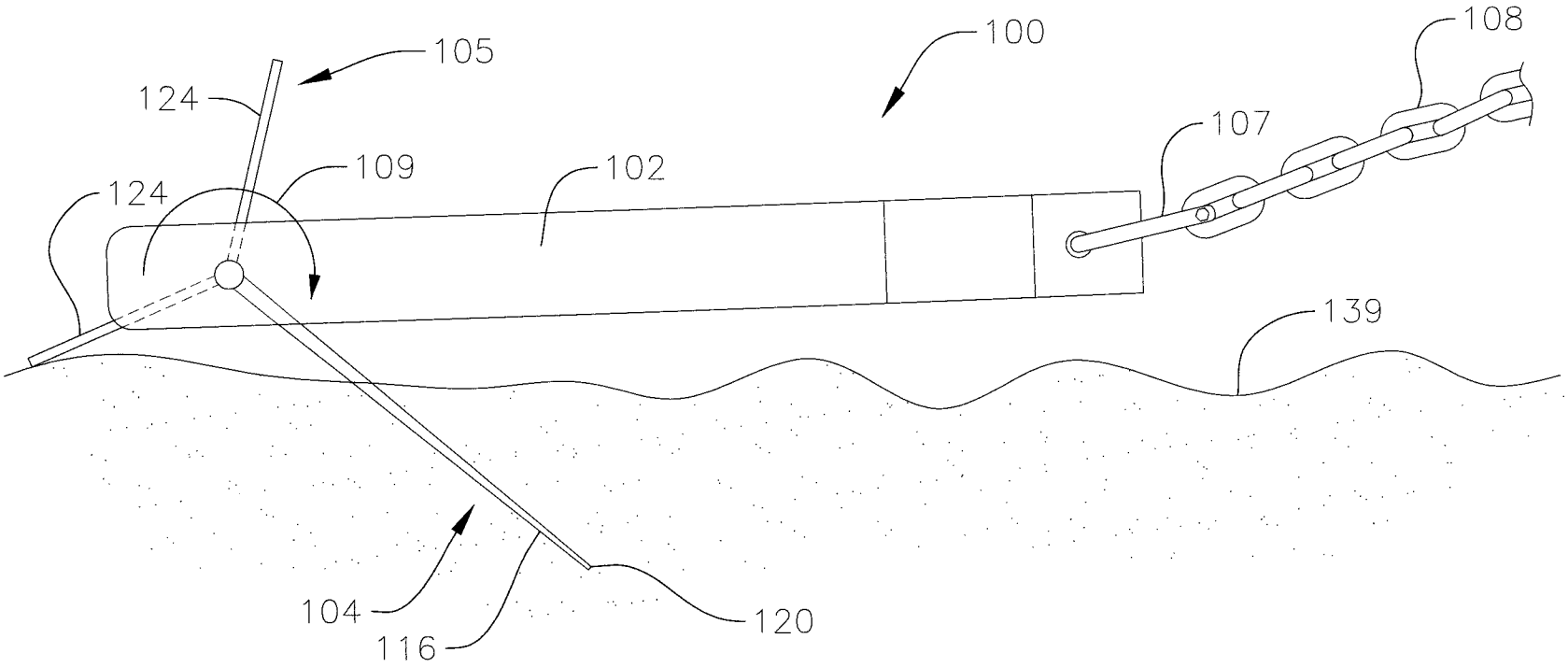
FIG. 6 is a side view depicting the embodiment of the collapsible anchor illustrated in FIGS. 1A-1B anchored to a seabed.
Figure 7B:
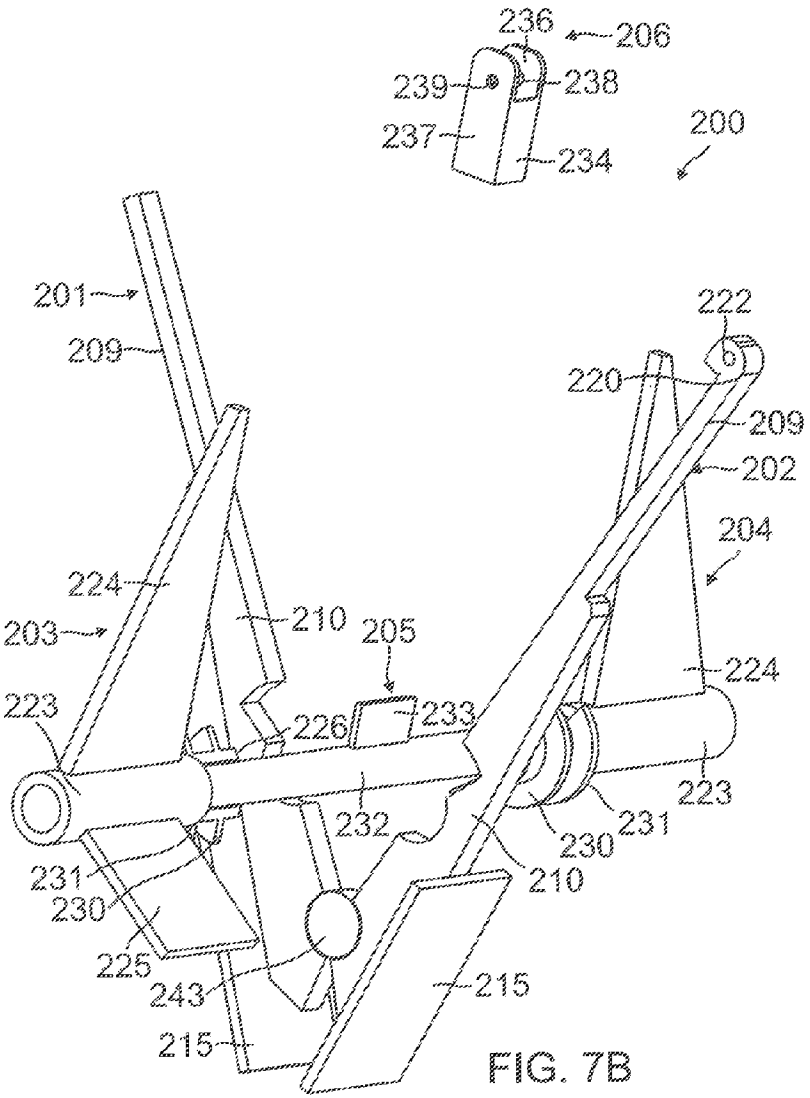
FIGS. 7A-7D are a perspective view, an exploded perspective view, a side view, and a front view, respectively, of a collapsible anchor according to another embodiment of the present disclosure.
Figure 7A:
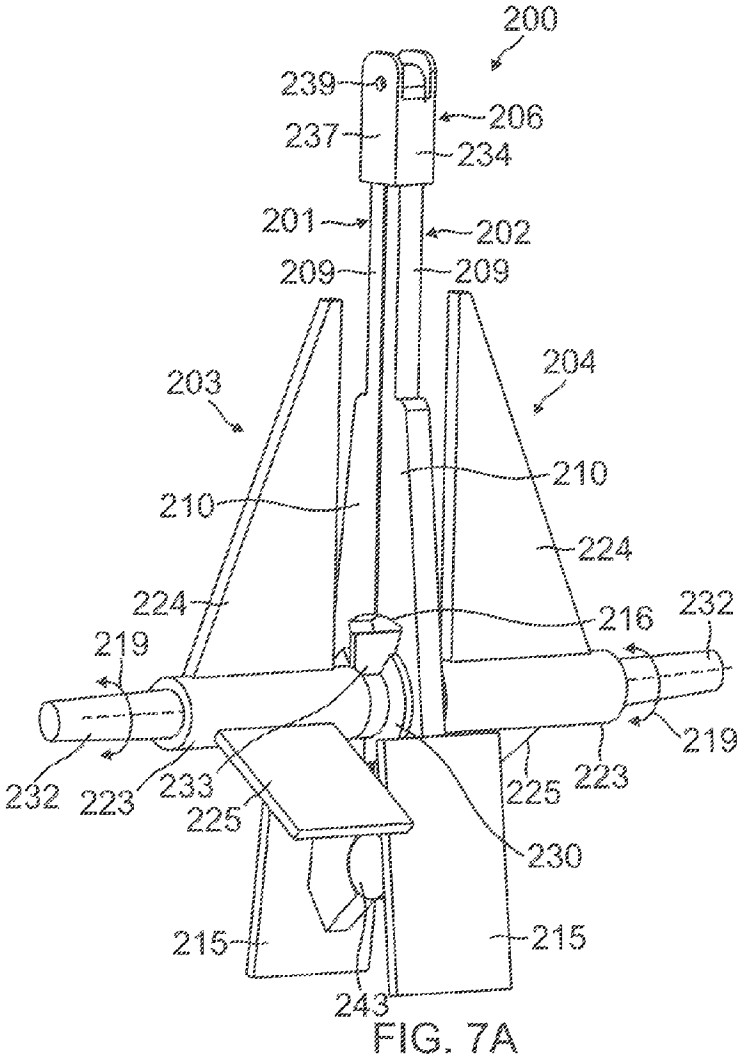
Figure 7D:
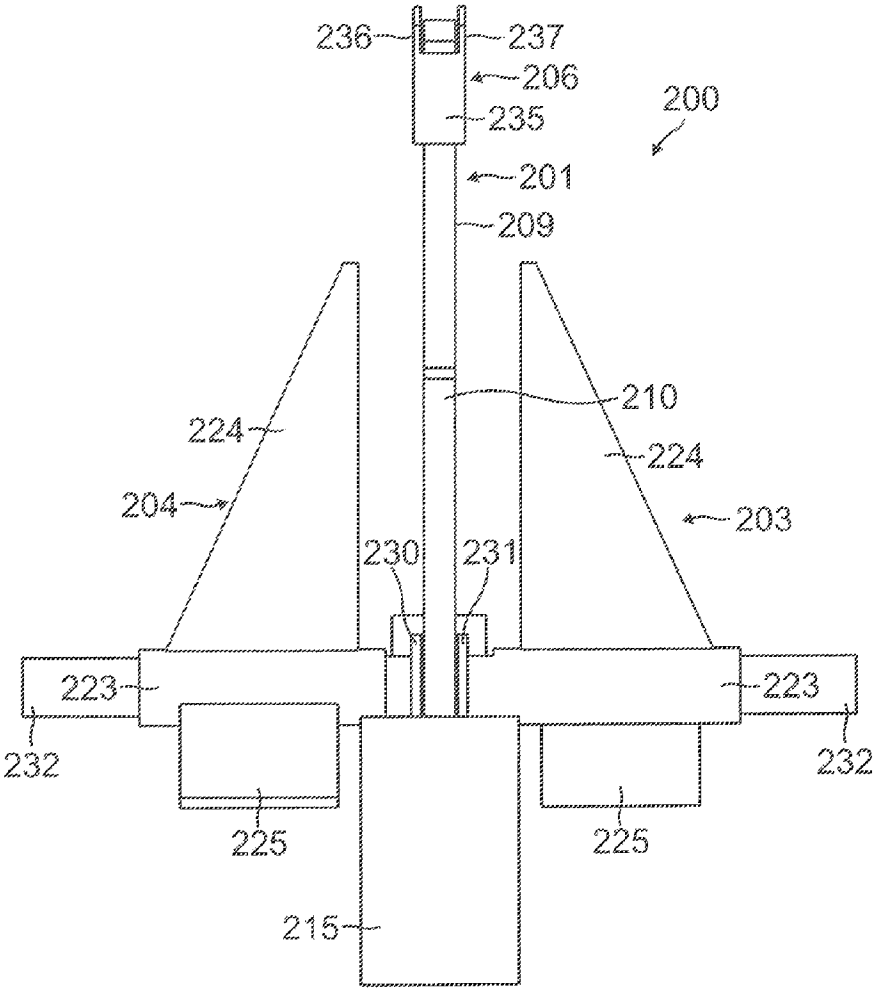
Figure 7C:
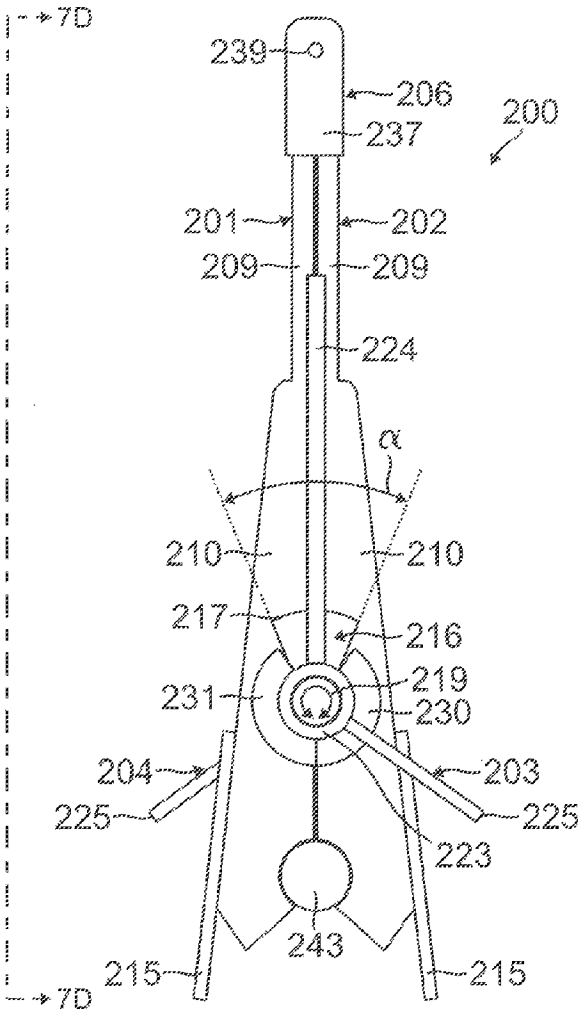

FIG. 6 depicts using the embodiment of the collapsible anchor 100 illustrated in FIGS. 1A-1B to anchor a sea vessel (e.g., a boat or a ship) to a seabed 139. When the collapsible anchor 100 is lowered onto the seabed 139, the shanks 101, 102 are configured to rotate down onto the seabed (e.g., such that the shanks 101, 102 are parallel or substantially parallel with the seabed 139). Additionally, as the collapsible anchor 100 is pulled in one direction (e.g., to the right in FIG. 6), the vane 124 of one of the vane assemblies 106 engages the seabed 139. As described above, the vanes 124 of the vane assemblies 106 extend in different directions (e.g., the vanes 124 are located on opposite sides of the fluke 104) such that the vane 124 of one of the vane assemblies 106 will be engaged by the seabed 139 if the collapsible anchor 100 is pulled in one direction and the vane 124 of the other vane assembly 106 will be engaged by the seabed 139 if the collapsible anchor 100 is pulled in the opposite direction. The engagement between the vane 124 of one of the vane assemblies 106 and the seabed 139 causes the vane assembly 106 that is engaged by the seabed 139 to rotate (arrow 109). Additionally, because the vane assemblies 105, 106 are coupled to the fluke 104 (e.g., the base plate 116 of the fluke 104 is received in the slots 129 defined between the bifurcated flange of each vane assembly 105, 106 and the connection member 122 of the fluke 104 is received in the channels 128 defined in each vane assembly 105, 106), the rotation (arrow 109) of the vane assembly 106 engaged by the seabed 109 causes the fluke 104 to rotate (arrow 109) relative to the shanks 101, 102 downward into the seabed 139 such that at least a portion of the fluke 104 is embedded in the seabed 139 (e.g., at least a portion of the fluke 104 penetrates the seabed 139). Additionally, the rotation (arrow 109) of the fluke 104 causes the vane assembly 105 not engaged by the seabed 139 to synchronously rotate (arrow 109) with the fluke 104 and the vane assembly 106 that is engaged by the seabed 139. In this manner, the vane assemblies 105, 106 are configured to aid in setting the anchor 100.

Additionally, in one embodiment, the vane assemblies 105, 106 may rotate (arrow 109) until the vanes 124 of the vane assemblies 105, 106 engage (e.g., contact) the return flanges 113 (see FIG. 1A) of the shanks 101, 102. Accordingly, in this manner, the return flanges 113 of the shanks 101, 102 are configured to function as stops preventing over-rotation of the fluke 104 and the vane assemblies 105, 106. Otherwise, the continued rotation (arrow 109) of the vane assemblies 105, 106 and the fluke 104 could permit the fluke 104 to disengage the seabed 139. The positions of the return flanges 113 on the shanks 101, 102 and/or the configuration of the vane assemblies 105, 106 may be selected based on the desired maximum angle of rotation of the vane assemblies 105, 106 and the fluke 104. Additionally, the stocks 130 of the vane assemblies 105, 106, which extend or project out from the lower segments 112 of the shanks 101, 102, are configured to engage the seabed 139 to provide roll stability to the collapsible anchor 100 (e.g., the stocks 130 are configured to prevent or mitigate the risk of the collapsible anchor 100 rolling). Otherwise, the rolling of the collapsible anchor 100 on the seabed 139 could inhibit the fluke 104 from penetrating (or adequately penetrating) the seabed 139.

With reference now to FIGS. 7A-7D, a collapsible anchor 200 according to another embodiment of the present disclosure includes a pair of shanks 201, 202 configured to be detachably coupled together, a pair of fluke and vane assemblies 203, 204 rotatably or pivotally coupled to the shanks 201, 202, a stop mechanism 205 configured to limit rotation of the fluke and vane assemblies 203, 204 relative to the shanks 201, 202, and a sleeve or collar 206 configured to couple the shanks 201, 202 together. The embodiment of the collapsible anchor 200 illustrated in FIGS. 7A-7D is a Danforth-type anchor. Additionally, in one or more embodiments, the collapsible anchor 200 includes an anchor shackle coupled to the sleeve 206 and the shanks 201, 202 and an anchor chain coupled to the anchor shackle and configured to couple the collapsible anchor 200 to a sea vessel (e.g., a ship or a boat).

Figure 8B:
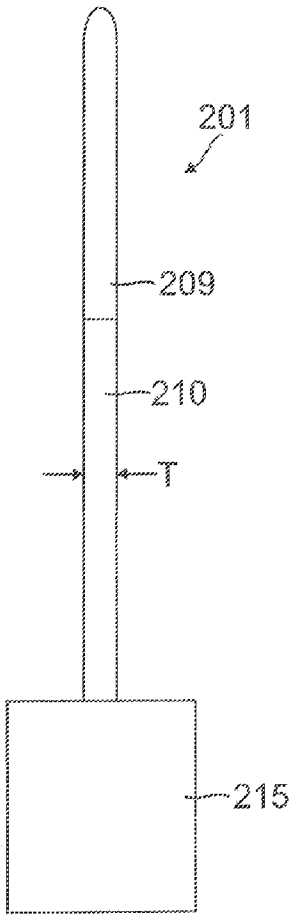
FIGS. 8A-8B are a side view and a rear view, respectively, of a pair of shanks of the embodiment of the collapsible anchor illustrated in FIGS. 7A-7D.
Figure 8A:
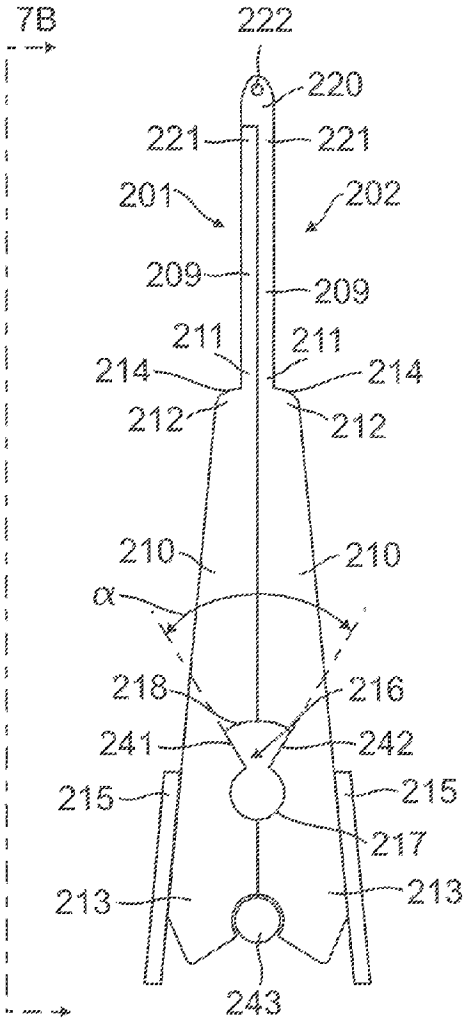

With reference to FIGS. 8A-8B, each of the shanks 201, 202 includes an upper stem 209 and a clamp portion 210 extending down from a lower end 211 of the upper stem 209. In one or more embodiments, each of the shanks 201, 202 may include an intermediate portion between the upper stem 209 and the clamp portion 210. In the illustrated embodiment, the clamp portion 210 of each shank tapers between a narrower upper end 212 and a wider lower end 213. In one or more alternate embodiments, the clamp portion 210 may not taper (e.g., the clamp portion 210 may be straight or substantially straight). Additionally, in the illustrated embodiment, a step or shoulder 214 is defined between the narrower upper end 212 of the clamp portion 210 and the lower end 211 of the upper stem 209. Additionally, in the illustrated embodiment, the shanks 201, 202 are hingedly coupled together by a hinge 243 coupled to the lower end 213 of the clamp portion 210 of each shank 201, 202. Accordingly, the shanks 201, 202 together function as a scissor hinge. Additionally, in the illustrated embodiment, each of the shanks 201, 202 includes an anchor side plate 215 connected to the lower end 213 of the clamp portion 210. In the illustrated embodiment, the anchor side plates 215 are flat rectangular members, although in one or more embodiments the anchor side plates 215 may have any other suitable shape. In one or more alternate embodiments, the collapsible anchor 200 may be provided without the anchor side plates 215.

Additionally, together the shanks 201, 202 define a keyhole-shaped opening 216. In the illustrated embodiment, the keyhole-shaped opening 216 includes a lower circular portion 217 and an upper arcuate portion 218 extending up from the lower circular portion 217. The upper arcuate portion 218 of the keyhole-shaped opening 216 may define any suitable angle $\alpha$ depending on the desired maximum degree of rotation (arrow 219 in FIGS. 7A, 7C, and 9C) of the fluke and vane assemblies 203, 204, as described in more detail below. For instance, in one or more embodiment, the angle $\alpha$ of the upper arcuate portion 218 of the keyhole-shaped opening 216 may be from approximately 50 degrees to approximately 90 degrees. In one or more embodiments, the angle $\alpha$ may be approximately 70 degrees. In one or more embodiments, the angle $\alpha$ of the upper arcuate portion 218 of the keyhole-shaped opening 216 may be any other suitable angle, such as less than approximately 50 degrees or greater than approximately 90 degrees.

Additionally, in the illustrated embodiment, one of the shanks 202 includes a crest 220 on an upper end 221 of the upper stem 209. In the illustrated embodiment, the crest 220 defines an opening 222 (e.g., a hole) configured to function as an attachment point for the sleeve 206 and the anchor shackle, as described in more detail below. Additionally, in the illustrated embodiment, the crest 220 on one of the shanks 201, 202 is configured to overhang the upper end 221 of the upper stem 209 of the other shank 201. Accordingly, in the illustrated embodiment the shanks 201, 202 are different. In one or more alternate embodiments, the shanks 201, 202 may be identical. For instance, in one or more embodiments, the opening 222 may be split between the two shanks 201, 202.

Figures 9A, 9B, 9C:
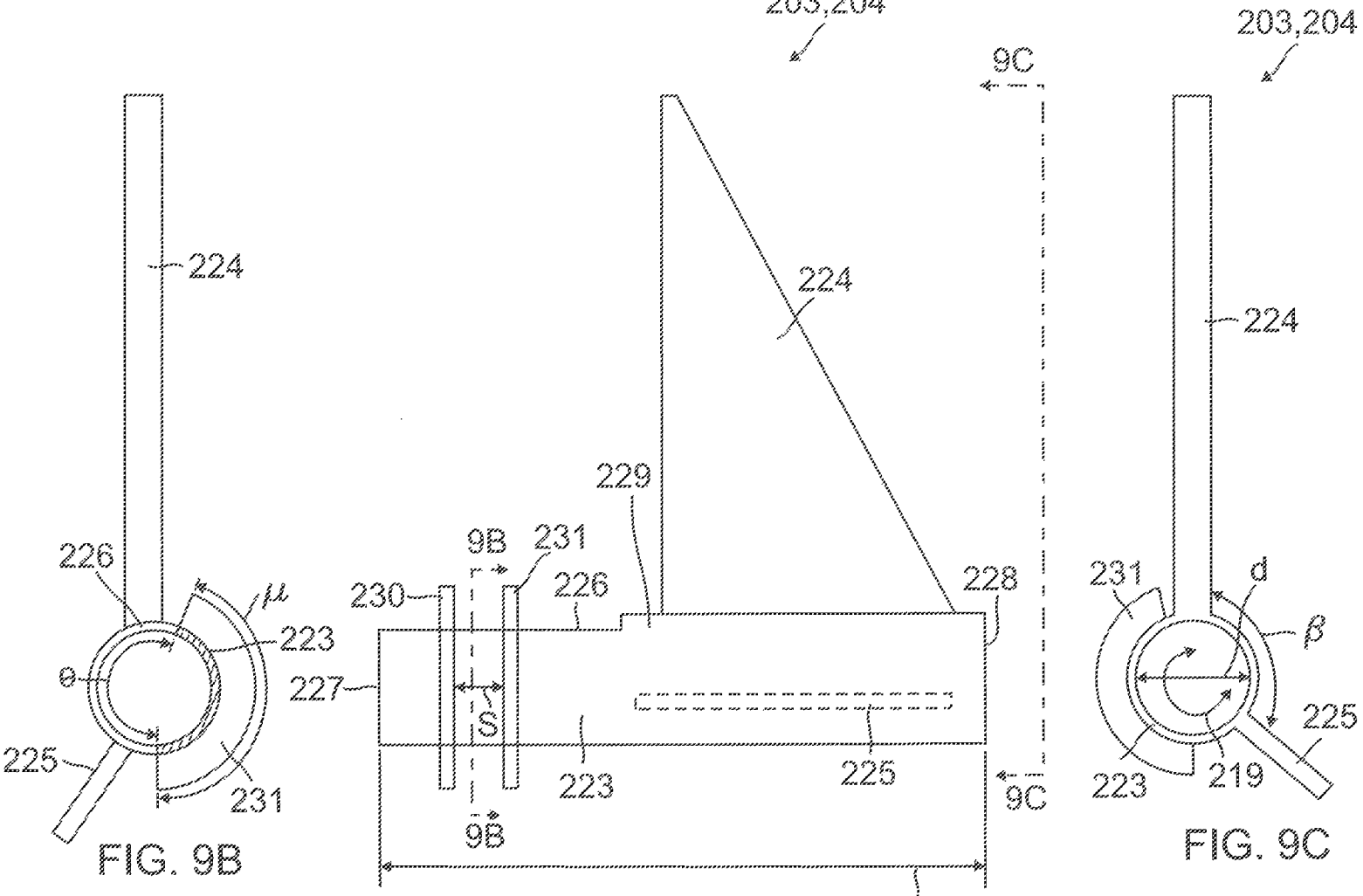
FIGS. 9A-9C are a rear view, a cross-sectional view, and a side view, respectively, of a fluke and vane assembly of the embodiment of the collapsible anchor illustrated in FIGS. 7A-7D.

With reference now to FIGS. 9A-9C, each of the fluke and vane assemblies 203, 204 includes a support member 223, a fluke 224 extending out from the support member 223 in a first direction, and a blade or vane 225 extending out from the support member 223 in a second direction different than the first direction. The fluke 224 may have any size suitable for the intended application, such as, for instance, a length from approximately 2 inches to approximately 8 inches (e.g., approximately 5 inches), a height from approximately 8 inches to approximately 16 inches (e.g., approximately 12 inches), and a thickness from approximately 1/16 inch to approximately 5/16 inch (e.g., approximately 3/16 inch). The vane 225 may have any size suitable for the intended application, such as, for instance, a length from approximately 2 inches to approximately 8 inches (e.g., approximately 5 inches), a height from approximately ½ inch to approximately 3 inches (e.g., approximately 1.5 inches), and a thickness from approximately 1/16 inch to approximately 5/16 inch (e.g., approximately 3/16 inch). Although in one or more embodiments the fluke 224 may have the same or substantially the same length as the vane 225, although in one or more embodiments the fluke 224 may have a different length than the vane 225 (e.g., the vane 225 may be longer than the fluke 224). In one or more embodiments, the fluke and vane assemblies 203, 204 are identical and therefore only a single fluke and vane assembly 203, 204 is illustrated in FIGS. 9A-9C. In one or more embodiments, the fluke 224 and the vane 225 may be positioned and/or oriented on the support member 223 such that any suitable angle $\beta$ is defined between the fluke 224 and the vane 225. For instance, in one or more embodiments, the angle $\beta$ defined between the fluke 224 and the vane 225 may be from approximately 100 degrees to approximately 170 degrees, such as, for instance, approximately 135 degrees or approximately 142 degrees. In one or more embodiments, any other suitable angle $\beta$ may be defined between the fluke 224 and the vane 225, such as, for instance, less than approximately 100 degrees or greater than approximately 170 degrees. Additionally, although in the illustrated embodiment the fluke 224 is triangular and the vane 225 is rectangular, in one or more embodiments, the fluke 223 and the vane 225 may have any other suitable shapes.

With continued reference to the embodiment illustrated in FIGS. 9A-9C, the support member 223 of each fluke and vane assembly 203, 204 is a cylindrical tube. The tubular support member 223 may have any size suitable for the intended application, such as, for instance, an outer diameter of approximately 0.5 inch to approximately 1.5 inch (e.g., approximately ⅞ inch) and an diameter from approximately ¼ inch to approximately 1 inch (e.g., approximately ½ inch). Additionally, in the illustrated embodiment, the support member 223 of each fluke and vane assembly 203, 204 defines an arcuate notch 226 extending along a length L of the support member 223 from an inner end 227 of the support member 223 toward an outer end 228 of the support member 223 (e.g., the arcuate notch 226 defined in the support member 223 extends along the length L of the support member 223 from the inner end 227 of the support member 223 to an intermediate portion 229 of the support member 223 between the inner and outer ends 227, 228 of the support member 223). The support member 223 of each fluke and vane assembly 203, 204 may have any length suitable for the intended application, such as, for instance, from approximately 4 inches to approximately 12 inches (e.g., approximately 8.5 inches). The arcuate notch 226 may extend any suitable length along the support member 223, such as, for instance, from approximately 1 inch to approximately 5 inches (e.g., approximately 3 inches). The arcuate notch 226 may extend any suitable angle $\theta$ around the support member 223, such as, for instance, from approximately 180 degrees to approximately 225 degrees. In one embodiment, the angle $\theta$ of the arcuate notch 226 may be approximately 200 degrees. The arcuate notches 226 in each of the support members 223 are configured to accommodate or receive a portion of the other support member 223. Accordingly, when the fluke and vane assemblies 203, 204 are brought together, a portion of the support member 223 of one of the fluke and vane assemblies 203 overlaps a portion of the support member 223 of the other fluke and vane assembly 204.

Additionally, in the illustrated embodiment, each of the fluke and vane assemblies 203, 204 includes a pair of arcuate ribs 230, 231 extending outward (e.g., radially outward) from the support member 223. The arcuate ribs 230, 231 may have any size suitable for the intended application, such as, for instance, a thickness from approximately ⅛ inch to approximately ½ inch (e.g., approximately ¼ inch). The arcuate ribs 230, 231 may extend any suitable angle μ around the support member 223, such as, for instance, from approximately 135 degrees to approximately 180 degree. In one or more embodiments, the angle μ of arcuate ribs 230, 231 and the angle θ of the arcuate notch 226 in each of the support members 223 may be explementary angles (i.e., sum to 360 degrees or approximately 360 approximately). In one or more embodiments, the arcuate ribs 230, 231 may extend any other suitable angle μ around the support member 223, such as, for instance, less than approximately 135. Additionally, although in the illustrated embodiment the each arcuate rib 230, 231 is a continuous member, in one or more embodiments, each arcuate rib 230, 231 may include two or more discrete segments. In the illustrated embodiment, the arcuate ribs 230, 231 are spaced apart by a distance S along the length L of the support member 223. In one or more embodiments, the distance S of the spacing between the arcuate ribs 230, 231 may be the same, substantially the same, or slightly larger than a thickness T of the clamp portion 210 of each of the shanks 201, 202 (see FIG. 7B). In one or more embodiments, the distance S of the spacing between the arcuate ribs 230, 231 may be from approximately ⅛ inch to approximately ½ inch (e.g., approximately ¼ inch). Additionally, in the illustrated embodiment, the arcuate ribs 230, 231 are located along the portion of the support member 223 along which the arcuate notch 226 extends. In one or more embodiments, the arcuate ribs 230, 231 may be centered or substantially centered along the length of the arcuate notch 226. Accordingly, when the fluke and vane assemblies 203, 204 are brought together, the arcuate ribs 230, 231 on one of the fluke and vane assemblies 203, 204 align with the arcuate ribs 230, 231 on the other fluke and vane assemblies 203, 204. Together, the arcuate ribs 230, 231 define annular or semi-annular ribs extending around the support members of the fluke and vane assemblies 203, 204.

Figure 10B:
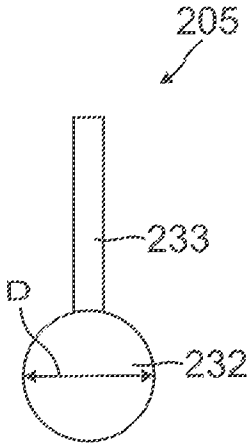
FIGS. 10A-10B are a rear view and a side view, respectively, of a stop mechanism of the embodiment of the collapsible anchor illustrated in FIGS. 7A-7D.
Figure 10A:
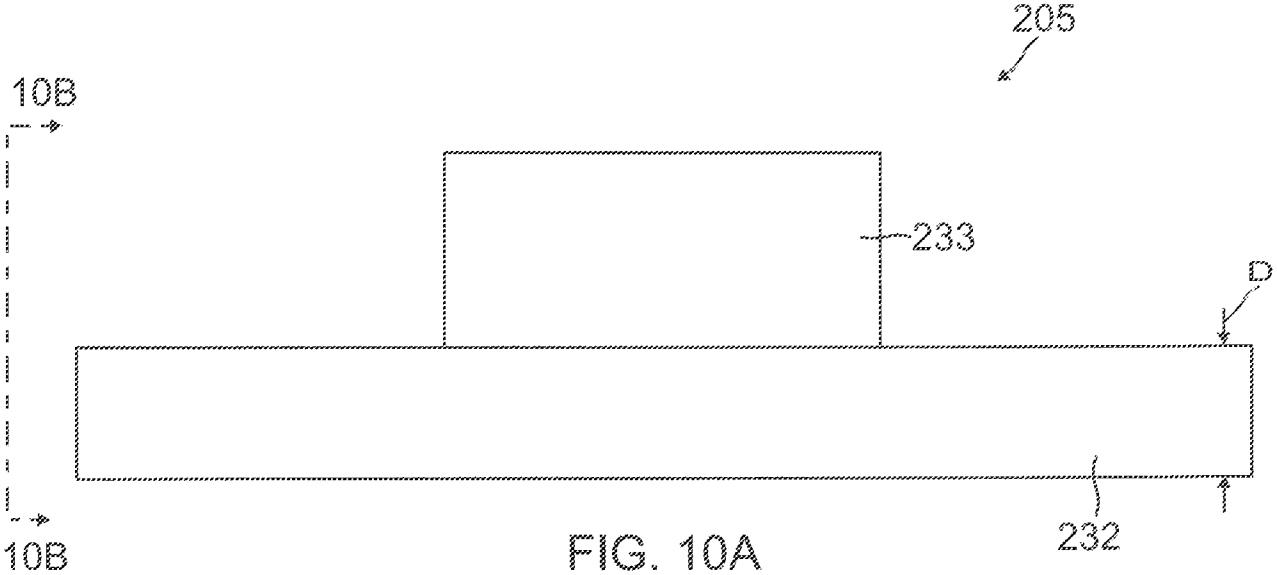

With reference now to FIGS. 10A-10B the stop mechanism 205 is configured to limit rotation (arrow 219 in FIGS. 7A, 7C, and 9C) of the fluke and vane assemblies 203, 204 relative to the shanks 201, 202. In the illustrated embodiment, the stop mechanism 205 includes a retention member 232 (e.g., a tube or rod) and a stop 233 extending outward from the retention member 232. In the illustrated embodiment, the stop 233 extends along a portion of the length of the retention member 232. In the illustrated embodiment the stop 233 is a flat rectangular plate member. The retention member 232 may have any size suitable for the intended application, such as, for instance, a diameter from approximately ⅛ inch to approximately ½ inch (e.g., approximately ½ inch) and a length from approximately 10 inches to approximately 30 inches (e.g., approximately 20 inches). The stop 233 may have any size suitable for the intended application, such as, for instance, a length from approximately 1 inch to approximately 5 inches (e.g., approximately 3 inches) and a thickness from approximately 1/16 inch to approximately ½ inch (e.g., ⅛ inch). Additionally, the stop 233 may extend any distance outward from an outer surface of the retention member 232, such as, for instance, from approximately 1/16 inch to approximately ½ inch (e.g., ⅛ inch). Additionally, in the illustrated embodiment the retention member 232 is cylindrical and has an outer diameter D equal, substantially equal, or slightly smaller than an inner diameter d (see FIG. 9C) of the support members 223 of the fluke and vane assemblies 203, 204. The retention member 232 of the stop mechanism 205 is configured to be received inside the support members 223 of the fluke and vane assemblies 203, 204. When the fluke and vane assemblies 203, 204 are brought together and the retention member 232 is received in the support members 223 of the fluke and vane assemblies 203, 204, the stop 233 of the stop mechanism 205 extends outward (e.g., radially outward) from the support members 223 of the fluke and vane assemblies 203, 204. Additionally, in the illustrated embodiment, the stop 233 extends out through the arcuate notches 226 in the support members 223 such that an inner end of the stop 233 is received or accommodated in the arcuate notches 226 of the support members 223. In the illustrated embodiment, the stop 233 is configured to axially align with (e.g., centered relative to) the arcuate ribs 230, 231 on the support members 223 of the fluke and vane assemblies 203, 204. In one or more embodiments, the length of the stop 223 is the same or substantially the same as the length of the arcuate notches 226 in the support members 233.

Figure 11A:
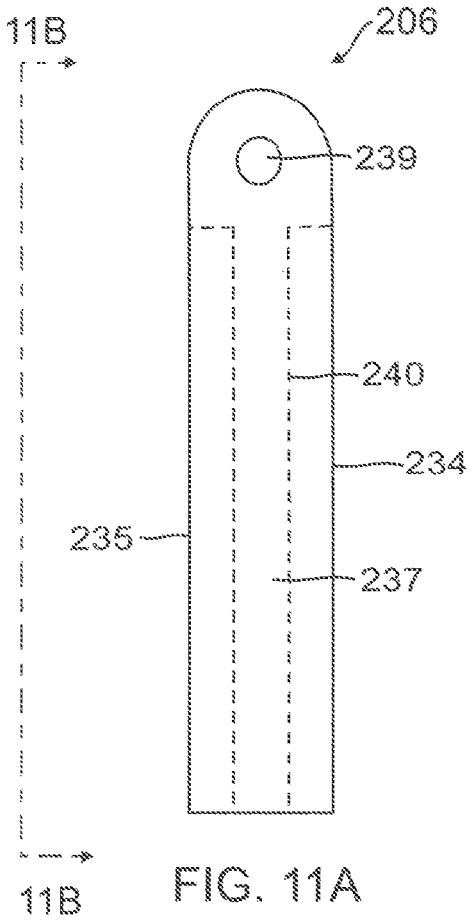
FIGS. 11A-11B are a side view and a front view, respectively, of a sleeve of the embodiment of the collapsible anchor illustrated in FIGS. 7A-7D.
Figure 11B:
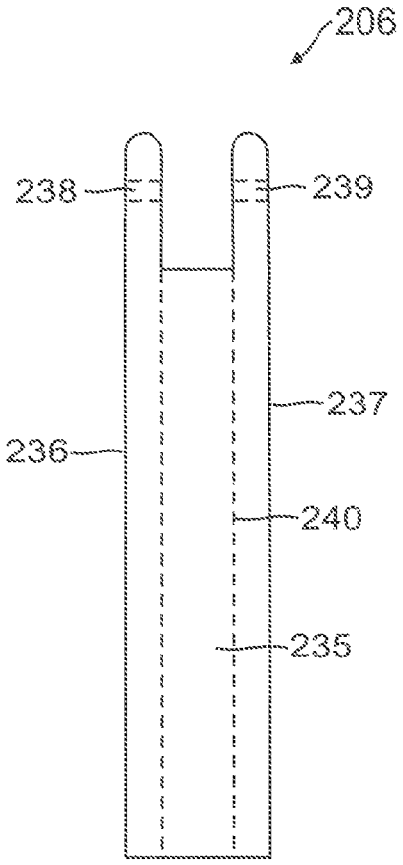

With reference now to FIGS. 11A-11B, the sleeve 206 is configured to couple the shanks 201, 202 together and enable the shanks 201, 202 to be readily separated (e.g., by rotating the shanks 201, 201 about the hinge 243) from each other. In the illustrated embodiment, the sleeve 206 includes a front wall 234, a rear wall 235, and a pair of side walls 236, 237 extending between opposite sides of the front and rear walls 234, 235. Additionally, in the illustrated embodiment, the side walls 236, 237 are taller than the front and rear walls 234, 235 and a portion of each of the side walls 236, 237 extend above the front and rear walls 234, 235. In the illustrated embodiment, the side walls 236, 237 each define an opening 238, 239 (e.g., a hole), respectively, above the front and rear walls 234, 235. Accordingly, the portion of each of the side walls 236, 237 that extend above the front and rear walls 234, 235 define a clevis. Additionally, together the front, rear, and side walls 234, 235, 236, 237 define a cavity 240 having open upper and lower ends.

To rotatably couple (arrow 219) the fluke and vane assemblies 203, 204 to the shanks 201, 202, the fluke and vane assemblies 203, 204 may be first brought together around the stop mechanism 205 by sliding the support members 223 of the fluke and vane assemblies 203, 204 toward each other along the retention member 232 of the stop mechanism 205. The fluke and vane assemblies 203, 204 may be slid toward each other until the inner portion of the support member 223 of each fluke and vane assembly 203, 204 is received in the arcuate notch 226 in the support member 223 of the other fluke and vane assembly 203, 204. When the fluke and vane assemblies 203, 204 are brought together around the stop mechanism 205, the stop 233 of the stop mechanism 205 extends into and out through the arcuate notches 226 in the support members 223 of the fluke and vane assemblies 203, 204 and outer ends of the retention member 232 extend out through the openings in the support members 223 of the fluke and vane assemblies 203, 204.

Additionally, when the fluke and vane assemblies 203, 204 are brought together, the vane 225 on one of the fluke and vane assemblies 203 extends in a first direction and the vane 225 on the other fluke and vane assembly 204 extends in a second direction different than the first direction, as illustrated in FIGS. 7A-7D (i.e., an angle is defined between the vanes 225 of the two fluke and vane assemblies 203, 204). In the illustrated embodiment, the vanes 225 are on opposite sides of the flukes 224 (i.e., when the collapsible anchor 200 is assembled, the vane 225 of one fluke and vane assemblies 204 is on one side of the corresponding fluke 224 and the vane 225 of the other fluke and vane assembly 204 is on an opposite side of the corresponding fluke 224). The shanks 201, 202 may then be separated (e.g., by rotating the upper stems 209 of the shanks 201, 202 outward away from each other about the hinge 243) and then brought together (e.g., by rotating the upper stems 209 of the shanks 201, 202 inward toward each other about the hinge 243) around the fluke and vane assemblies 203, 204 such that a portion of each of the fluke and vane assemblies 203, 204 is received in the keyhole-shaped opening 216 defined by the shanks 201, 202. In the illustrated embodiment, when the shanks 201, 202 are brought together around the fluke and vane assemblies 203, 204, the portions of the support members 223 between the arcuate ribs 230, 231 are received in the lower circular portion 217 of the keyhole-shaped opening 216 and the stop 233 extends up into the upper arcuate portion 218 of the keyhole-shaped opening 216. Accordingly, the lower circular portion 217 of the keyhole-shaped opening 216 is configured to engage the support members 223 of the fluke and vane assemblies 203, 204 to retain the fluke and vane assemblies 203, 204 coupled to the shanks 201, 202 and the upper arcuate portion 218 of the keyhole-shaped opening 216 is configured to permit the fluke and vane assemblies 203, 204 to pivot or rotate (arrow 219) relative to the shanks 201, 202 to the degree permitted by the angle $\alpha$ of the upper arcuate portion 218 of the keyhole-shaped opening 216. Additionally, as described in more detail below, the stop 233 is configured to engage opposite ends 241, 242 of the upper arcuate portion 218 of the keyhole-shaped opening 216 to limit the extent (i.e., degree) to which the fluke and vane assemblies 203, 204 can rotate or pivot (arrow 219) relative to the shanks 201, 202. For instance, when the collapsible anchor 200 is in a neutral position (e.g., the flukes 224 are inline with the shanks 201, 202), the fluke and vane assemblies 203, 204 may rotate (arrow 219) in a first direction up to half of the angle $\alpha$ of the arcuate portion 218 of the keyhole-shaped opening 216 until the stop 233 engages one end 241 of the upper arcuate portion 218 of the keyhole-shaped opening 216 and the fluke and vane assemblies 203, 204 may rotate (arrow 219) in a second direction opposite the first direction up to half of the angle $\alpha$ of the arcuate portion 218 of the keyhole-shaped opening 216 until the stop 233 engages the other end 242 of the upper arcuate portion 218 of the keyhole-shaped opening 216.

To couple the shanks 201, 202 together, the upper stems 209 of the shanks 201, 202 may be placed against each other and then the sleeve 206 may be slid down over the upper stems 209 of the shanks 201, 202 such that the upper stems 209 of the shanks 201, 202 extend up through the cavity 240 defined in the sleeve 206. Additionally, the sleeve 206 may be slid down along the upper stems 209 of the shanks 201, 202 until the openings 238, 239 defined in the front and rear walls 234, 235 of the sleeve 206 are aligned with the opening 222 defined in the crest 220 of one of the shanks 202. In one or more embodiments, the sleeve 206 may be sized to extend from the opening 222 defined in the crest 220 of one of the shanks 202 down to the junction or shoulder between the upper stems 209 and the clamp portions 210 of the shanks 201, 202 (e.g., the sleeve 206 may configured to extend along the entire length or substantially the entire length of the upper stems 209 of the shanks 201, 202). In one or more embodiments, the sleeve 206 may have any other suitable size such that the sleeve 206 is configured to extend along any other suitable portion of the upper stems 209 of the shanks 201, 202, such as, for instance, approximately ⅕ the length of the upper stems 209 or more. The engagement between the sleeve 206 and the upper stems 209 of the shanks 201, 202 is configured to restrict or constrain all degrees of freedom of the shanks 201, 202 to maintain the integrity of the anchor 200 when assembled. The shanks 201, 202 and the sleeve 206 may then be coupled together by inserting the anchor shackle through the aligned openings 222, 238, 239 in the shank 202 and the sleeve 206. The anchor shackle may be coupled to one end of an anchor chain and an opposite end of the anchor chain may be coupled to a sea vessel (e.g., a ship or a boat) that is intended to be anchored by the collapsible anchor 200. The shanks 201, 202 may be detached from each other (e.g., for storage and/or transportation) by removing the anchor shackle from the openings 222, 238, 239 in the shank 202 and the sleeve 206 and sliding the sleeve 206 up off of the upper stems 209 of the shanks 201, 202 such that the upper stems 209 of the shanks 201, 202 are withdrawn through the cavity 240 defined in the sleeve 206. In one or more embodiments, the collapsible anchor 200 may be provided without the sleeve 206 and the shanks 201, 202 may be detachably coupled together by any other suitable mechanism, such as, for instance, with one or more fasteners.

When the embodiment of the collapsible anchor illustrated in FIGS. 7A-7D is used to anchor a sea vessel (e.g., a boat or a ship) to a seabed, the shanks 201, 202 are configured to rotate (arrow 219) down onto the seabed (e.g., such that the shanks 201, 202 are parallel or substantially parallel with the seabed). Additionally, as the collapsible anchor 200 is pulled in one direction, the vane 225 of one of the fluke and vane assemblies 204 engages the seabed. The engagement between the vane 225 of one of the fluke and vane assemblies 204 and the seabed causes the vane 225 that is engaged by the seabed to rotate (arrow 219). The rotation (arrow 219) of the vane engaged by the seabed causes the fluke 224 of the fluke and vane assembly 204 to rotate (arrow 219) relative to the shanks 201, 202 downward into the seabed such that at least a portion of the fluke 224 is embedded in the seabed (e.g., at least a portion of the fluke 224 penetrates the seabed). Additionally, the rotation (arrow 219) of the fluke and vane assembly 204 engaged by the seabed causes the fluke and vane assembly 203 not engaged by the seabed to synchronously rotate with the fluke and vane assembly 204 engaged by the seabed. In this manner, the vanes 225 of the fluke and vane assemblies 203, 204 are configured to aid in setting the anchor 200.

Additionally, in one embodiment, the fluke and vane assemblies 203, 204 may rotate until the stop 233 of the stop mechanism 205 engages one end 241, 242 of the upper arcuate portion 218 of the keyhole-shaped opening 216 in the shanks 201, 202. Accordingly, in this manner, the engagement between the stop 233 and one end 241, 242 of the upper arcuate portion 218 of the keyhole-shaped opening 216 in the shanks 201, 202 is configured to prevent over-rotation of the fluke and vane assemblies 203, 204. Otherwise, the continued rotation of the fluke and vane assemblies 203, 204 could permit the fluke 224 to disengage the seabed.

The angle α of the upper arcuate portion 218 of the keyhole-shaped opening 216 and/or the configuration of the stop 233 may be selected based on the desired maximum angle of rotation (arrow 219) of the fluke and vane assemblies 203, 204. Additionally, the anchor side plates 215, which are connected to the lower ends of the shanks 201, 202, are configured to engage the seabed to provide roll stability to the collapsible anchor 200 (e.g., the anchor side plates 215 are configured to prevent or mitigate the risk of the collapsible anchor 200 rolling). Similarly, the outer ends of the retention member 232 of the stop mechanism 205, which extend or project out from the openings in the support members 223 of the fluke and vane assemblies 203, 204 (see FIG. 7A), are configured to engage the seabed to provide roll stability to the collapsible anchor 200 (e.g., the outer ends of the retention member 232 are configured to prevent or mitigate the risk of the collapsible anchor 200 rolling). Otherwise, the rolling of the collapsible anchor 200 on the seabed could inhibit the flukes 224 from penetrating (or adequately penetrating) the seabed. Accordingly, the retention member 232 of the stop mechanism 205 is configured to function as a stock.

Figure 12B:
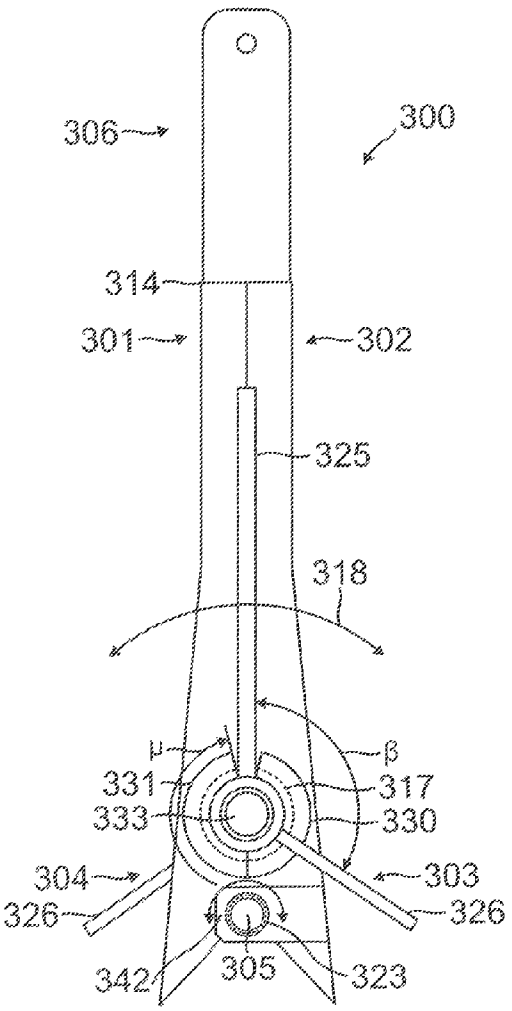
FIGS. 12A-12C are an assembled perspective view, a side view, and an exploded perspective view, respectively, of a collapsible anchor according to another embodiment of the present disclosure.
Figure 12A:
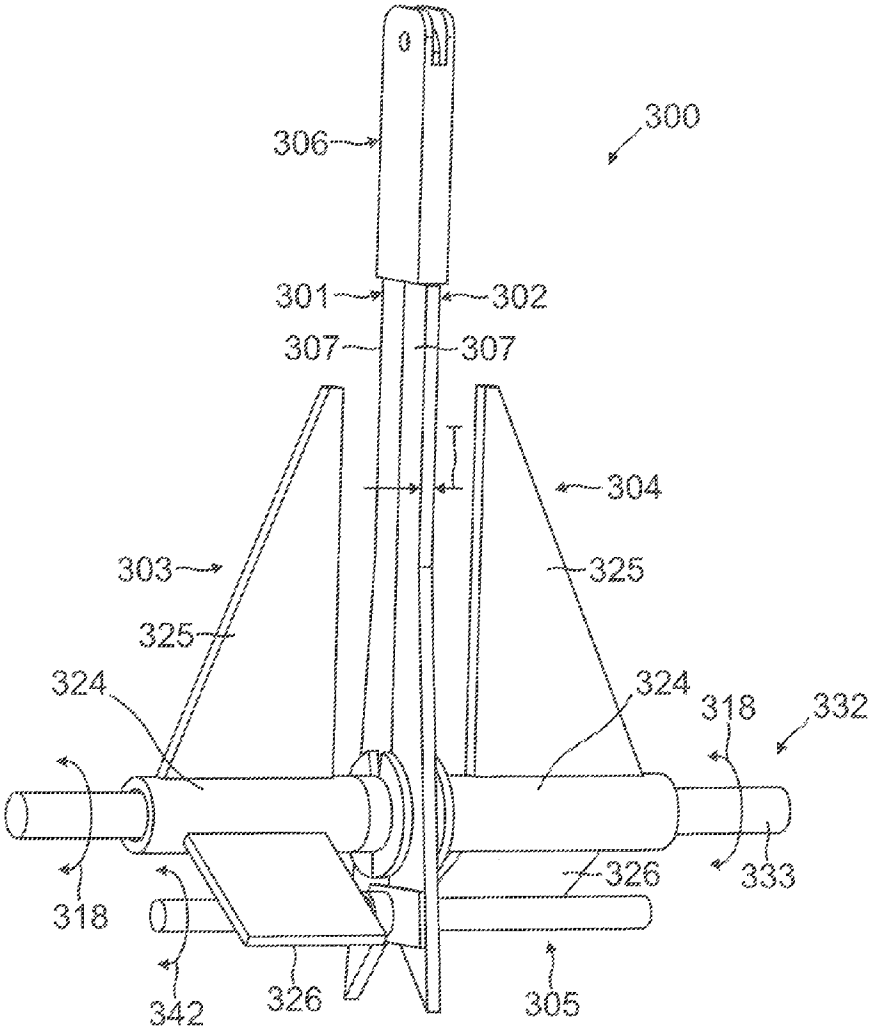
Figure 12C:
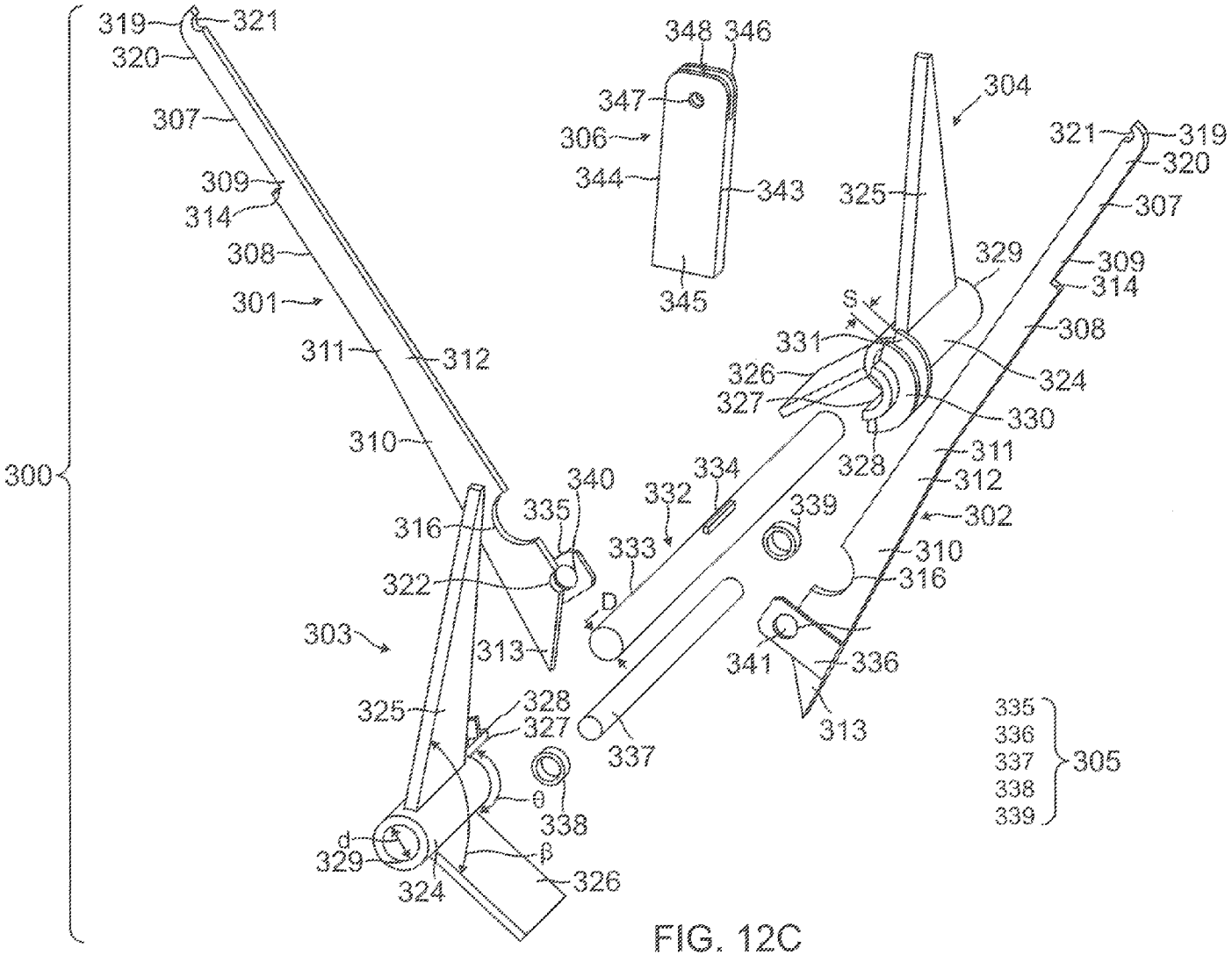

With reference now to FIGS. 12A-12C, a collapsible anchor 300 according to another embodiment of the present disclosure includes a pair of shanks 301, 302 configured to be detachably coupled together, a pair of fluke and vane assemblies 303, 304 rotatably or pivotally coupled to the shanks 301, 302, a hinge and stop assembly 305 configured to permit limited rotation of the fluke and vane assemblies 303, 304 relative to the shanks 301, 302, and a sleeve or collar 306 configured to couple the shanks 301, 302 together.

In the illustrated embodiment, each of the shanks 301, 302 includes an upper stem 307, an intermediate portion 308 extending down from a lower end 309 of the upper stem 307, and a clamp portion 310 extending down from a lower end 311 of the intermediate portion 308. In the illustrated embodiment, the clamp portion 310 of each shank 301, 302 tapers between a narrower upper end 312 and a wider lower end 313. In one or more alternate embodiments, the clamp portion 310 may not taper (e.g., the clamp portion 310 may be straight or substantially straight). Additionally, in the illustrated embodiment, a step or shoulder 314 is defined between an upper end 315 of the intermediate portion 308 and the lower end 309 of the upper stem 307.

Additionally, in the illustrated embodiment, the clamp portion 310 of each shank 301, 302 defines a notch 316 (e.g., a semi-circular notch). When the shanks 301, 302 are coupled together in the closed position (FIGS. 12A-12B), the notches 316 cooperate to define an opening 317. In the illustrated embodiment, the opening 317 is circular. As described in more detail below, the opening 317 defined by the shanks 301, 302 is configured to rotatably (arrow 318) accommodate the fluke and vane assemblies 303, 304.

Additionally, in the illustrated embodiment, each of the shanks 301, 302 includes a crest portion 319 on an upper end 320 of the upper stem 307. In the illustrated embodiment, each crest portion 319 defines a recess 321. When the shanks 301, 302 are coupled together in the closed position, the recesses 321 cooperate to define an opening (e.g., a hole) configured to function as an attachment point for the sleeve 306 and the anchor shackle, as described in more detail below. Although the illustrated embodiment, the first shank 301 has the same configuration as the second shank 302, in one or more embodiments, the first and second shanks 301, 302 may have different configurations. For instance, in one or more embodiments, the crest and the attachment point for the sleeve 306 and the anchor shackle may be provided on only one of the shanks 301, 302. In one or more embodiments, the upper ends of the shanks 301, 302 be the same as, or similar to, the upper ends of the shanks 201, 202 described above with reference to the embodiment of the collapsible anchor 200 illustrated in FIGS. 7A-7B (e.g., one of the shanks may include a crest defining an opening that overhangs the upper end of the upper stem portion of the other shank).

With continued reference to the embodiment illustrated in FIGS. 12A-12C, the clamp portion 310 of each shank 301, 302 defines a lower notch 322 (e.g., a lower arcuate notch). In the illustrated embodiment, the lower notches 322 are below the notches 316 that define the opening 317 configured to rotatably (arrow 318) accommodate the fluke and vane assemblies 303, 304. The lower notches 322 cooperate to define an opening 323 configured to receive and accommodate a portion of the hinge and stop assembly 305, as described in more detail below.

With continued reference to the embodiment illustrated in FIGS. 12A-12C, each of the fluke and vane assemblies 303, 304 includes a support member 324, a fluke 325 extending out from the support member 324 in a first direction, and a blade or vane 326 extending out from the support member 324 in a second direction different than the first direction. The fluke 325 and the vane 326 may have any size suitable for the intended application of the collapsible anchor 300, such as, for instance, any of the sizes described above with reference to the embodiment of the fluke 224 and the vane 225 illustrated in FIGS. 7A-11B. In one or more embodiments, the fluke 325 and the vane 326 may be positioned and/or oriented on the support member 324 such that any suitable angle β is defined between the fluke 325 and the vane 326. For instance, in one or more embodiments, the angle β defined between the fluke 325 and the vane 326 may be from approximately 100 degrees to approximately 170 degrees, such as, for instance, approximately 135 degrees or approximately 142 degrees. In one or more embodiments, any other suitable angle β may be defined between the fluke 224 and the vane 225, such as, for instance, less than approximately 100 degrees or greater than approximately 170 degrees. Additionally, although in the illustrated embodiment the fluke 325 is triangular and the vane 326 is rectangular, in one or more embodiments, the fluke 325 and the vane 326 may have any other suitable shapes.

Still referring to the embodiment illustrated in FIGS. 12A-12C, the support member 324 of each fluke and vane assembly 303, 304 is a cylindrical tube. The support member 324 may have any size suitable for the intended application, such as, for instance, an outer diameter of approximately 0.5 inch to approximately 1.5 inch (e.g., approximately ⅞ inch) and an inner diameter from approximately ¼ inch to approximately 1 inch (e.g., approximately ½ inch). Additionally, in the illustrated embodiment, the support member 324 of each fluke and vane assembly 303, 304 defines an arcuate notch 327 extending along a length of the support member 324 from an inner end 328 of the support member 324 toward an outer end 329 of the support member 324. The support member 324 of each fluke and vane assembly 303, 304 may have any length suitable for the intended application, such as, for instance, from approximately 4 inches to approximately 12 inches (e.g., approximately 8.5 inches). The arcuate notch 327 may extend any suitable length along the support member 324, such as, for instance, from approximately 1 inch to approximately 5 inches (e.g., approximately 3 inches). The arcuate notch 327 may extend any suitable angle θ around the support member 324, such as, for instance, from approximately 180 degrees to approximately 225 degrees. In one embodiment, the angle θ of the arcuate notch 327 may be approximately 200 degrees. The arcuate notch 327 in each of the support members 324 is configured to accommodate or receive a portion (e.g., the inner end 328) of the other support member 324. Accordingly, when the fluke and vane assemblies 303, 304 are brought together, a portion of the support member 324 of one of the fluke and vane assemblies 303 overlaps a portion of the support member 324 of the other fluke and vane assembly 304.

Additionally, in the illustrated embodiment, each of the fluke and vane assemblies 303, 304 includes a pair of arcuate ribs 330, 331 extending outward (e.g., radially outward) from the support member 324. The arcuate ribs 330, 331 may have any size suitable for the intended application, such as, for instance, a thickness from approximately ⅛ inch to approximately ½ inch (e.g., approximately ¼ inch). The arcuate ribs 330, 331 may extend any suitable angle μ around the support member 324, such as, for instance, from approximately 135 degrees to approximately 180 degree. In one or more embodiments, the angle μ of arcuate ribs 330, 331 and the angle θ of the arcuate notch 327 in each of the support members 324 may be explementary angles (i.e., sum to 360 degrees or approximately 360 approximately). In one or more embodiments, the arcuate ribs 330, 331 may extend any other suitable angle μ around the support member 324, such as, for instance, less than approximately 135. Additionally, although in the illustrated embodiment the each arcuate rib 330, 331 is a continuous member, in one or more embodiments, each arcuate rib 330, 331 may include two or more discrete segments. In the illustrated embodiment, the arcuate ribs 330, 331 are spaced apart by a distance S along the length of the support member 324. In one or more embodiments, the distance S of the spacing between the arcuate ribs 330, 331 may be the same, substantially the same, or slightly larger than a thickness T of the clamp portion 310 of each of the shanks 301, 301 (see FIG. 12A). In one or more embodiments, the distance S of the spacing between the arcuate ribs 330, 331 may be from approximately ⅛ inch to approximately ½ inch (e.g., approximately ¼ inch). Additionally, in the illustrated embodiment, the arcuate ribs 330, 331 are located along the portion of the support member 324 along which the arcuate notch 327 extends. In one or more embodiments, the arcuate ribs 330, 331 may be centered or substantially centered along the length of the arcuate notch 327. Accordingly, when the fluke and vane assemblies 303, 304 are brought together, the arcuate ribs 330, 331 on one of the fluke and vane assemblies 303, 304 align with the arcuate ribs 331, 330, respectively, on the other fluke and vane assemblies 203, 204. Together, the arcuate ribs 330, 331 define annular or semi-annular ribs extending around the support members 324 of the fluke and vane assemblies 303, 304.

Still referring to the embodiment illustrated in FIGS. 12A-12C, the collapsible anchor 300 also includes a key mechanism 332 configured to key the first fluke and vane assembly 303 to the second fluke and vane assembly 304. The key mechanism 332 is configured to rotatably couple the first fluke and vane assembly 303 to the second fluke and vane assembly 304 such that the first and second fluke and vane assemblies 303, 304 are configured to rotate (arrow 318) synchronously. In the illustrated embodiment, the key mechanism 332 includes an insertion member 333 (e.g., a tube or rod) and a key 334 extending outward from the insertion member 333. In the illustrated embodiment, the key 334 extends along a portion of the length of the insertion member 333. In the illustrated embodiment the key 334 is a flat rectangular plate member. The insertion member 333 may have any size suitable for the intended application, such as, for instance, a diameter from approximately ⅛ inch to approximately ½ inch (e.g., approximately ½ inch) and a length from approximately 10 inches to approximately 30 inches (e.g., approximately 20 inches). The key 334 may have any size suitable for the intended application, such as, for instance, a length from approximately 1 inch to approximately 5 inches (e.g., approximately 3 inches) and a thickness from approximately 1/16 inch to approximately ½ inch (e.g., ⅛ inch). Additionally, the key 334 may extend any distance outward from an outer surface of the insertion member 333, such as, for instance, from approximately 1/16 inch to approximately ½ inch (e.g., ⅛ inch). Additionally, in the illustrated embodiment the insertion member 333 is cylindrical and has an outer diameter D equal, substantially equal, or slightly smaller than an inner diameter d of the support members 324 of the fluke and vane assemblies 303, 304.

The insertion member 333 of the key mechanism 332 is configured to be received inside the support members 324 of the fluke and vane assemblies 303, 304. When the fluke and vane assemblies 303, 304 are brought together and the insertion member 333 is received in the support members 324 of the fluke and vane assemblies 303, 304, the key 334 of the key mechanism 332 extends outward (e.g., radially outward) and at least partially into the arcuate notches 327 defined in the support members 324 (e.g., the key 334 is received or accommodated in the arcuate notches 327 of the support members 324). Accordingly, unlike the embodiment of the collapsible anchor 200 illustrated in FIGS. 7A-7B in which the stop 233 extends completely through the arcuate notches 226 in the support members 223 of the fluke and vane assemblies 203, 204 and outward from the outer surface of the support members 223, the key 334 according to the embodiment of the key mechanism 332 illustrated in FIGS. 12A-12C does extend out beyond the outer surfaces of the support members 324 of the fluke and vane assemblies 303, 304 (i.e., the key 334 does not extend out of the arcuate notches 327 in the fluke and vane assemblies 303, 304). Additionally, in the illustrated embodiment, the key 334 is configured to axially align with (e.g., centered relative to) the arcuate ribs 330, 331 on the support members 324 of the fluke and vane assemblies 303, 304. In one or more embodiments, the length of the key 334 is the same or substantially the same as the length of the arcuate notches 327 in the support members 324. Additionally, when the fluke and vane assemblies 303, 304 are brought together around the key mechanism 332, the insertion member 333 extends completely through the support members 324 such that outer end portions of the insertion member 333 of the key mechanism 332 are exposed, the significance of which is described below.

With continued reference to the embodiment illustrated in FIGS. 12A-12C, the hinge and stop assembly 305 includes a first attachment member 335, a second attachment member 336, a rod 337, and a pair of retention members 338, 339. The first attachment member 335 is coupled to the first shank 301 and the second attachment member 336 is coupled to the second shank 302. The first and second attachment members 335, 336 may be coupled to the first and second shanks 301, 302, respectively, in any suitable manner, such as, for instance, welding and/or mechanical fastening. Although in the illustrated embodiment the attachment members 335, 336 are separate components from the shanks 301, 302, in one or more alternate embodiments, the attachment members 335, 336 may be integrally formed with the first and second shanks 301, 302, respectively. Additionally, in the illustrated embodiment, the first and second attachment members 335, 336 are generally rectangular flat plates, although in one or more embodiments, the first and second attachment members 335, 336 may have any other suitable shape. In the illustrated embodiment, the first and second attachment members 335, 336 are coupled to opposite sides of the first and second shanks 301, 302. Additionally, in the illustrated embodiment, the first and second attachment members 335, 336 each define an opening 340, 341 (e.g., a hole), respectively. The openings 340, 341 defined in the first and second attachment members 335, 336, respectively, are aligned (e.g., coaxial) with the opening 323 defined by the cooperation of the lower notches 322 in the shanks 301, 302.

The rod 337 is configured to extend through the openings 340, 341 in the first and second attachment members 335, 336 and the opening 323 defined by the cooperation of the lower notches 322 in the shanks 301, 302. The retention members 338, 339 are configured to prevent the rod 337 from sliding out of the openings 340, 341 in the attachment members 335, 336 and the opening 323 defined in the shanks 301, 302. The retention members are larger (e.g., have a larger outer diameter) than the openings 340, 341 in the first and second attachment members 335, 336. In the illustrated embodiment, the first retention member 338 is coupled to the rod 337 and is configured to engage (e.g., contact) the first attachment member 335 and the second retention member 336 is coupled to the rod 337 and is configured to engage (e.g., contact) the second attachment member such that the retention members 338, 339 are positioned on opposite sides of the shanks 301, 302. Accordingly, the retention members 338, 339 are configured to restrict the axial movement of the rod 337. In the illustrated embodiment, the retention members 338, 339 are annular members (e.g., rings) configured to be slid onto the rod 337 and then coupled to the rod 337. The retention members 338, 339 may be coupled to the rod 337 in any suitable manner, such as, for instance, by welding and/or mechanical fastening. The retention members 338, 339 may be either fixedly coupled to the rod 337 or detachably coupled to the rod 337. In one or more embodiments, the retention members 338, 339 may have any other configuration suitable for restricting the axial movement of the rod 337 to prevent the rod 337 from sliding out of the openings 340, 341 in the attachment members 335, 336 and the opening 323 defined in the shanks 301, 302. For instance, in one or more embodiments, the retention members 338, 339 may be clamps. As described in more detail below, the rod 337 is configured to function as a both a hinge that hingedly couples (arrow 342) the first and second shanks 301, 302 together and as a stop that limits the extent to which the fluke and vane assemblies 303, 304 can rotate (arrow 318).

Still referring to the embodiment illustrated in FIGS. 12A-12C, the sleeve 306 is configured to couple the shanks 301, 302 together. The sleeve 306 is also configured to be readily detached from the shanks 301, 302 to enable the shanks 301, 302 to be separated from each other (e.g., by rotating (arrow 342) the shanks 301, 302 about the rod 337) and the collapsible anchor 300 to be disassembled. In the illustrated embodiment, the sleeve 306 includes a front wall 343, a rear wall 344, and a pair of side walls 345, 346 extending between opposite sides of the front and rear walls 343, 344. Additionally, in the illustrated embodiment, the side walls 345, 346 each define an opening 347 (e.g., a hole) above the front and rear walls 343, 344. Together the front, rear, and side walls 343, 344, 345, 346 define a cavity 348 having open upper and lower ends. In one or more embodiments, the sleeve 306 may have the same or similar configuration as the embodiment of the sleeve 206 described above with reference to the embodiment of the collapsible anchor 200 illustrated in FIGS. 7A-11B. In one or more embodiments, the collapsible anchor 300 may be provided without the sleeve 306 and the shanks 301, 302 may be detachably coupled together by any other suitable mechanism, such as, for instance, with one or more fasteners.

To assemble the collapsible anchor 300, the insertion member 333 of the key mechanism 332 may be inserted into the support members 324 of the fluke and vane assemblies 303, 304. The fluke and vane assemblies 303, 304 may then be brought together, for example, by sliding the support members 324 of the fluke and vane assemblies 303, 304 along the insertion member 333 of the key mechanism 332. As the fluke and vane assemblies 303, 304 are brought together, an inner portion of the support member 324 of each fluke and vane assembly 303, 304 is inserted into the arcuate notch 327 in the support member 324 of the other fluke and vane assembly 303, 304. Additionally, when the fluke and vane assemblies 303, 304 are brought together, the vane 326 on one of the fluke and vane assemblies 303 extends in a first direction and the vane 326 on the other fluke and vane assembly 304 extends in a second direction different than the first direction, as illustrated in FIGS. 12A-12B (i.e., an angle is defined between the vanes 326 of the two fluke and vane assemblies 303, 304). In the illustrated embodiment, the vanes 326 are on opposite sides of the flukes 325 (i.e., when the collapsible anchor 300 is assembled, the vane 326 of one fluke and vane assemblies 304 is on one side of the corresponding fluke 325 and the vane 326 of the other fluke and vane assembly 304 is on an opposite side of the corresponding fluke 325).

The shanks 301, 302 may then be rotatably coupled together by inserting the rod 337 through the opening 340 in the first attachment member 335 coupled to the first shank 301, through the opening 323 defined by the cooperation of the lower notches 322 in the first and second shanks 301, 302, and through the opening 341 defined in the second attachment member 336 coupled to the second shank 302. The axial position of the rod 337 within the openings 340, 323, 341 may then be fixed by coupling the retention members 338, 339 to the rod 337 (e.g., by welding) such that the retention members 338, 339 are on opposite sides of the shanks 301, 302. In the illustrated embodiment, the retention members 338, 339 are coupled to the rod 337 such that the first retention member 338 engages (e.g., abuts or contacts) the first attachment member 335 and the second retention member 339 engages (e.g., abuts or contacts) the second attachment member 336. When the rod 337 is inserted through the openings 340, 341, 323 in the attachment members 335, 336 and the shanks 301, 302, the shanks 301, 302 are configured to rotate (arrow 342) about the rod 337 between an open position in which the shanks 301, 302 are spaced apart from each other and a closed position in which the shanks 301, 302 contact each other. In this manner, the rod 337 functions as a hinge (e.g., lower ends of the clamp portions 310 of the shanks 301, 302 are hingedly coupled together by the rod 337 such that the shanks 301, 302 together function as a scissor hinge).

The shanks 301, 302 may then be separated, for instance, by grasping the upper stems 307 of the shanks 301, 302 and rotating (arrow 342) the shanks 301, 302 outward away from each other about the rod 337. The fluke and vane assemblies 303, 304 and the key mechanism 332, which is received in the support members 324 of the fluke and vane assemblies 303, 304, may then be inserted between the separated shanks 301, 302. The shanks 301, 302 may then be brought together (e.g., by grasping the upper stems 307 of the shanks 301, 302 and rotating (arrow 342) the shanks 301, 302 inward toward each other about the rod 337) around the fluke and vane assemblies 303, 304 such that the portions of the support members 324 between the arcuate ribs 330, 331 are received in the circular opening 317 defined by the shanks 301, 302. The circular opening 317 defined by the shanks 301, 302 is configured to permit the fluke and vane assemblies 303, 304 to pivot or rotate (arrow 318) relative to the shanks 301, 302.

To couple the shanks 301, 302 together in the closed position, the sleeve 306 may be slid down over the upper stems 307 of the shanks 301, 302 such that the upper stems 307 of the shanks 301, 302 extend up through the cavity 348 defined in the sleeve 306. Additionally, the sleeve 306 may be slid down along the upper stems 307 of the shanks 301, 302 until the openings 347 defined in the front and side walls 345, 346 of the sleeve 306 are aligned with the opening defined by the cooperation of the recesses 321 in the crest portions 319 of the shanks 301, 302. Additionally, in the illustrated embodiment, sleeve 306 may be slid down along the upper stems 307 of the shanks 301, 302 until a lower end of the sleeve 306 contacts (e.g., is supported on) the shoulders 314 of the shanks 301, 302. In the illustrated embodiment, the sleeve 306 is sized to extend from the opening defined by the cooperation of the recesses 321 in the crest portions 319 of the shanks 301, 302 down to the shoulders 314 defined between the upper stems 307 and the clamp portions 310 of the shanks 301, 302 (e.g., the sleeve 306 extends along the entire length or substantially the entire length of the upper stems 307 of the shanks 301, 302). In one or more embodiments, the sleeve 306 may have any other suitable size such that the sleeve 306 is configured to extend along any other suitable portion of the upper stems 307 of the shanks 301, 302, such as, for instance, approximately ⅕ the length of the upper stems 307 or more. The engagement between the sleeve 306 and the upper stems 307 of the shanks 301, 302 is configured to restrict or constrain all degrees of freedom of the shanks 301, 302 to maintain the integrity of the anchor 300 when assembled. The shanks 301, 302 and the sleeve 306 may then be coupled together by inserting the anchor shackle through the aligned openings in the shanks 301, 302 and the sleeve 306. The anchor shackle may be coupled to one end of an anchor chain and an opposite end of the anchor chain may be coupled to a sea vessel (e.g., a ship or a boat) that is intended to be anchored by the collapsible anchor 300.

The collapsible anchor 300 may be disassembled (e.g., for storage and/or transportation) by removing the anchor shackle from the openings in the shanks 301, 302 and the sleeve 306 and sliding the sleeve 306 up off of the upper stems 307 of the shanks 301, 302 such that the upper stems 307 of the shanks 301, 302 are withdrawn through the cavity 348 defined in the sleeve 306. The shanks 301, 302 may then be separated by rotating (arrow 342) the shanks 301, 302 outward away from each other about the rod 337. The fluke and vane assemblies 303, 304 and the key mechanism 332 may then be detached from the separated shanks 301, 302.

Figure 12D:
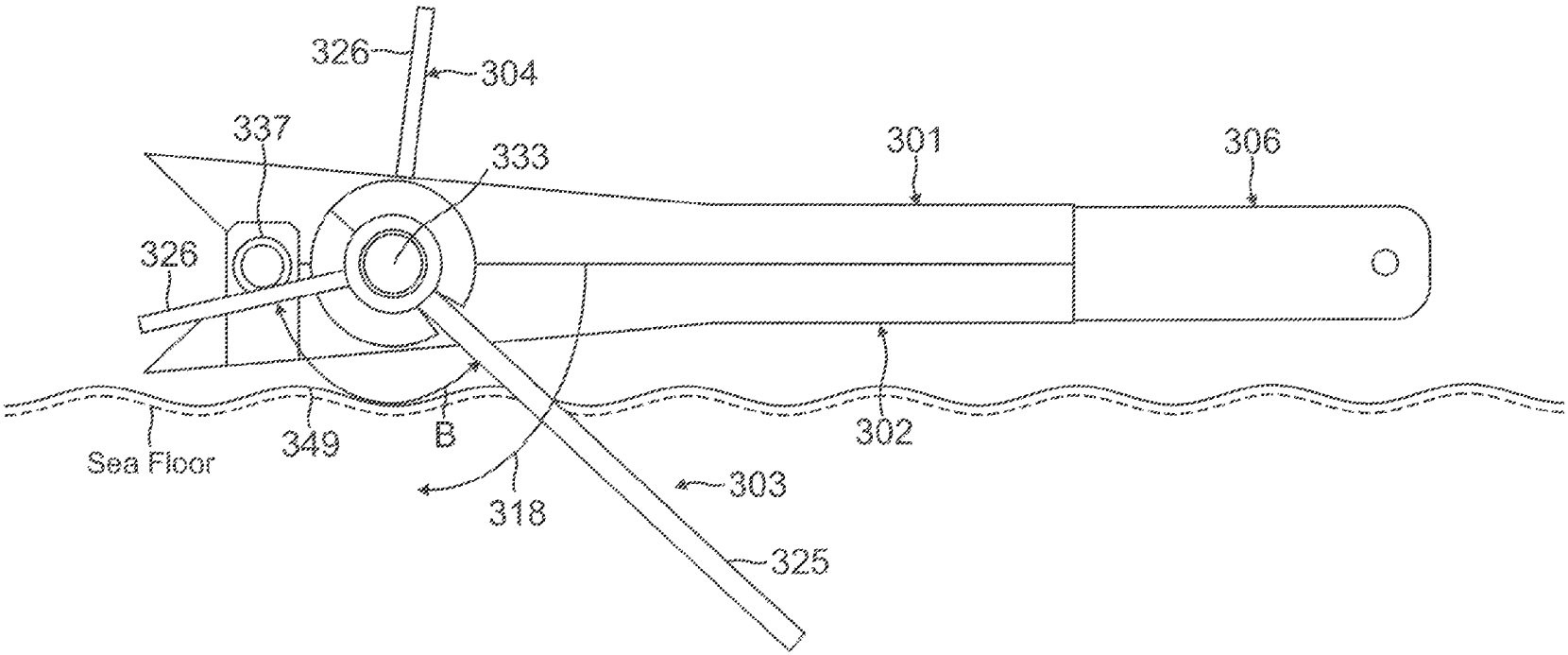
FIG. 12D is a side view depicting the embodiment of the collapsible anchor illustrated in FIGS. 12A-12C anchored to a seabed.

With reference now to FIG. 12D, when the embodiment of the collapsible anchor 300 illustrated in FIGS. 12A-12C is used to anchor a sea vessel (e.g., a boat or a ship) to a seabed 349, the shanks 301, 302 are configured to rotate down onto the seabed 349 (e.g., such that the shanks 301, 302 are parallel or substantially parallel with the seabed 349). Additionally, as the collapsible anchor 300 is pulled in one direction (e.g., to the right in FIG. 12D), the vane 326 of one of the fluke and vane assemblies 304 engages the seabed 349. As described above, the vanes 326 of the fluke and vane assemblies 303, 304 extend in different directions (e.g., the vanes 326 are located on opposite sides of the flukes 325) such that the vane 326 of one of the fluke and vane assemblies 304 will be engaged by the seabed 349 if the collapsible anchor 300 is pulled in one direction (e.g., to the right in FIG. 12D) and the vane 326 of the other fluke and vane assembly 303 will be engaged by the seabed 349 if the collapsible anchor 300 is pulled in the opposite direction (e.g., to the left in FIG. 12D). The engagement between the vane 326 of one of the fluke and vane assemblies 304 and the seabed 349 causes the vane 326 that is engaged by the seabed 349 to rotate (arrow 318). The rotation (arrow 318) of the vane 326 that is engaged by the seabed 349 causes the fluke 325 of the fluke and vane assembly 304 to rotate (arrow 318) relative to the shanks 301, 302 downward into the seabed 349 such that at least a portion of the fluke 325 is embedded in the seabed 349 (e.g., at least a portion of the fluke 325 penetrates the seabed 349). Additionally, the rotation (arrow 318) of the fluke and vane assembly 304 engaged by the seabed 349 causes the fluke and vane assembly 303 not engaged by the seabed 349 to synchronously rotate (arrow 318) with the fluke and vane assembly 304 engaged by the seabed 349 such that the flukes 325 of both fluke and vane assembly 303, 304 are configured to be at least partially embedded in the seabed 349.

In the illustrated embodiment, the fluke and vane assemblies 303, 304 are configured rotate (arrow 318) until the vane 326 of one of the fluke and vane assemblies 303, 304 contacts the rod 337 of the hinge and stop assembly 305. The degree to which the fluke and vane assemblies 303, 304 are configured rotate relative to the shanks 301, 302 depends on the configuration of the vanes 326 and the rod 337. For instance, in the illustrated embodiment, when the collapsible anchor 300 is in a neutral position (e.g., the flukes 325 are in-line with the shanks 301, 302), the fluke and vane assemblies 303, 304 may rotate (arrow 318) in a first direction up to an angle $\sigma$ that is approximately supplementary to the angle $\beta$ defined between the vane 326 and the fluke 325 of one of the fluke and vane assemblies 304, at which point the vane 326 will contact the rod 337, which will prevent further rotation (arrow 318) of the fluke and vane assemblies 303, 304 in the first direction. Similarly, when the collapsible anchor 300 is in a neutral position, the fluke and vane assemblies 303, 304 may rotate (arrow 318) in a second direction opposite the first direction up to an angle that is approximately supplementary to the angle $\beta$ defined between the vane 326 and the fluke 325 of the other fluke and vane assembly 303, at which point the vane 326 will contact the rod 337, which will prevent further rotation (arrow 318) of the fluke and vane assemblies 303, 304 in the second direction. In this manner, the engagement between the vane 326 of one of the fluke and vane assemblies 303, 304 and the rod 337 of the hinge and stop assembly 305 is configured to prevent over-rotation of the fluke and vane assemblies 303, 304. Otherwise, the continued rotation of the fluke and vane assemblies 303, 304 could permit the flukes 325 to disengage the seabed 349. The angle $\beta$ between the vane 326 and the fluke 325 of each fluke and vane assembly 303, 304 and/or the configurations of the vanes 326 and/or the rod 337 may be selected based on the desired maximum angle of rotation (arrow 318) of the fluke and vane assemblies 303, 304 in either direction relative to the shanks 301, 302.

Additionally, the ends of the insertion member 333 of the key mechanism 332, which extend out through the support members 324 of the fluke and vane assemblies 303, 304, are configured to engage the seabed 349 to provide roll stability to the collapsible anchor 300 (e.g., the ends of the insertion member 333 of the key mechanism 332 are configured to prevent or mitigate the risk of the collapsible anchor 300 rolling). Otherwise, the rolling of the collapsible anchor 300 on the seabed could inhibit the flukes 325 from penetrating (or adequately penetrating) the seabed 349. Accordingly, the insertion member 333 of the key mechanism 332 is configured to function as a stock.

While this invention has been described in detail with particular references to embodiments thereof, the embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention. Although relative terms such as "inner," "outer," "upper," "lower," and similar terms have been used herein to describe a spatial relationship of one element to another, it is understood that these terms are intended to encompass different orientations of the various elements and components of the invention in addition to the orientation depicted in the figures. Additionally, as used herein, the term "substantially" and similar terms are used as terms of approximation and not as terms of degree, and are intended to account for the inherent deviations in measured or calculated values that would be recognized by those of ordinary skill in the art. Furthermore, as used herein, when a component is referred to as being "on" or "coupled to" another component, it can be directly on or attached to the other component or intervening components may be present therebetween. Any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein.

What is claimed is:

1. A collapsible anchor, comprising:

a first shank;

a second shank configured to be detachably coupled to the first shank;

at least one fluke configured to be hingedly coupled to the first and second shanks, the fluke configured to move between a stowed position and a deployed position;

a first vane configured to be hingedly coupled to the first shank;

a second vane configured to be hingedly coupled to the second shank; and at least one stop configured to limit rotation of the first and second vanes relative to the first and second shanks, a rod hingedly coupling the first shank to the second shank, and wherein outer portions of the rod define the at least one stop that is configured to limit rotation of the first and second vanes relative to the first and second shanks; and wherein when the first and second vanes and the at least one fluke are hingedly coupled to the first and second shanks, the first vane extends in a first direction and the second vane extends in a second direction different than the first direction.

2. The collapsible anchor of claim 1, wherein the at least one stop comprises a first stop and a second stop, the first stop comprising a first return flange on a lower end of the first shank configured to engage the first vane, and the second stop comprising a second return flange on a lower end of the second shank configured to engage the second vane.

3. The collapsible anchor of claim 1, wherein when the first and second shanks are coupled together, the first and second shanks together define a keyhole opening, and wherein the at least one stop extends into an arcuate portion of the keyhole opening and is configured to engage ends of the arcuate portion of the keyhole opening to limit rotation of the first and second vanes relative to the first and second shanks.

4. The collapsible anchor of claim 3, wherein the arcuate portion defines an angle from approximately 50 degrees to approximately 90 degrees.

5. The collapsible anchor of claim 1, further comprising a sleeve configured to couple upper end portions of the first and second shanks together.

6. The collapsible anchor of claim 5, further comprising an anchor shackle configured to couple the upper end portions of the first and second shanks to the sleeve.

7. The collapsible anchor of claim 1, wherein when the first shank is coupled to the second shank, the first and second shanks together form a wishbone configuration.

8. The collapsible anchor of claim 1, wherein when the first shank is coupled to the second shank, the first and second shanks together form a scissor hinge.

9. The collapsible anchor of claim 1, further comprising:

a first stock connected to the first vane and configured to rotatably couple the first vane to the first shank; and a second stock connected to the second vane and configured to rotatably couple the second vane to the second shank, wherein when the first and second vanes are rotatably coupled to the first and second shanks by the first and second stocks, the first stock extends out from the first shank and the second stock extends out from the first shank to provide roll stability.

10. The collapsible anchor of claim 9, further comprising:

a first bifurcated flange connected to the first vane and configured to detachably couple the first vane to the at least one fluke; and a second bifurcated flange connected to the second vane and configured to detachably couple the second vane to the at least one fluke.

11. The collapsible anchor of claim 10, wherein the at least one fluke further comprises a connection member, and wherein the collapsible anchor further comprises a first enlarged segment defining a first channel connected to the first vane and a second enlarged segment defining a second channel connected to the second vane, and wherein the first and second channels are configured to slidably receive portions of the connection member to couple the first and second vanes to the at least one fluke.

12. The collapsible anchor of claim 1, wherein the at least one fluke comprises a first fluke and a second fluke, and wherein the collapsible anchor further comprises a first support member fixedly coupling the first fluke to the first vane and a second support member fixedly coupling the second fluke to the second vane.

13. The collapsible anchor of claim 12, wherein the first support member defines a first semi-annular notch and the second support member defines a corresponding second semi-annular notch such that the first support member is configured to matedly engage the second support member.

14. The collapsible anchor of claim 12, wherein each of the first and second support members comprises a pair of spaced apart semi-annular ribs, and wherein the semi-annular ribs are configured to engage the first and second shanks to prevent lateral movement of the first and second vanes and the first and second flukes relative to the first and second shanks.

15. The collapsible anchor of claim 12, further comprising a stop mechanism comprising a retention member, the retention member configured to extend through the first and second support members, wherein the at least one stop is connected to the retention member, and wherein the at least one stop is configured to extend into an arcuate portion of a keyhole opening defined by the first and second shanks.

16. The collapsible anchor of claim 1, further comprising a first anchor side plate connected to a lower end of the first shank and a second anchor side plate connected to a lower end of the second shank.

17. The collapsible anchor of claim 1, wherein when the second shank is detachably coupled to the first shank, and wherein an upper end portion of the second shank is detachably connected to an upper end portion of the first shank, and wherein when disconnected the first shank and the second shank may be manually completely separated from each other and from the fluke and said first and second vanes.

18. A collapsible anchor, comprising:

a first shank comprising a first return flange;

a second shank configured to be detachably coupled to the first shank, the second shank comprising a second return flange;

a fluke configured to be hingedly coupled to the first and second shanks, the fluke configured to move between a stowed position and a deployed position;

a first vane assembly configured to be detachably coupled to the fluke and hingedly coupled to the first shank; and a second vane assembly configured to be detachably coupled to the fluke and hingedly coupled to the second shank, wherein the first vane assembly and the second vane assembly each comprise:

an upper blade comprising a bifurcated flange;

a vane extending from a lower end of the upper blade; and a stock extending outward from a junction between the upper blade and the vane, wherein the stock of the first vane assembly is configured to rotatably couple the first vane assembly to the first shank and the stock of the second vane assembly is configured to rotatably coupled the second vane assembly to the second shank, wherein the return flange of the first shank is configured to engage the vane of the first vane assembly and the return flange of the second shank is configured to engage the vane of the second vane assembly to limit rotation of the first and second vane assemblies relative to the first and second shanks, and wherein when the first and second vane assemblies and the fluke are hingedly coupled to the first and second shanks, the vane of the first vane assembly extends in a first direction and the vane of the second vane assembly extends in a second direction different than the first direction.

19. A collapsible anchor, comprising:

a first shank;

a second shank configured to be detachably coupled to the first shank;

a first fluke and vane assembly configured to be hingedly coupled to the first shank;

a second fluke and vane assembly configured to be hingedly coupled to the second shank, the first and second fluke and vane assemblies each configured to move between a stowed position and a deployed position;

a stop mechanism comprising a stop;

wherein the first and second fluke and vane assemblies each comprise:

a support member defining an arcuate notch;

a fluke extending in a first direction from the support member; and a vane extending from the support member in a second direction different than the first direction;

wherein when the first and second shanks are coupled together, the first and second shanks together define a keyhole opening configured to receive a portion of the support member of each of the first and second fluke and vane assemblies, wherein when the first and second fluke and vane assemblies are pivotably coupled to the first and second shanks, a portion of the support member of the first fluke and vane assembly extends into the arcuate notch in the support member of the second fluke and vane assembly and a portion of the support member of the second fluke and vane assembly extends into the arcuate notch in the support member of the first fluke and vane assembly, and wherein when the first and second fluke and vane assemblies are pivotably coupled to the first and second shanks, the stop extends into an arcuate portion of the keyhole opening and is configured to engage ends of the arcuate portion of the keyhole opening to limit rotation of the first and second fluke and vane assemblies relative to the first and second shanks.

20. A collapsible anchor, comprising:

a first shank;

a second shank configured to be detachably coupled to the first shank;

a first fluke and vane assembly configured to be hingedly coupled to the first shank;

a second fluke and vane assembly configured to be hingedly coupled to the second shank, the first and second fluke and vane assemblies each configured to move between a stowed position and a deployed position;

a hinge and stop assembly comprising a rod configured to hingedly couple the first shank to the second shank;

wherein the first and second fluke and vane assemblies each comprise:

a support member defining an arcuate notch;

a fluke extending in a first direction from the support member; and a vane extending from the support member in a second direction different than the first direction;

wherein when the first and second shanks are coupled together, the first and second shanks together define a circular opening configured to receive a portion of the support member of each of the first and second fluke and vane assemblies, wherein when the first and second fluke and vane assemblies are pivotably coupled to the first and second shanks, a portion of the support member of the first fluke and vane assembly extends into the arcuate notch in the support member of the second fluke and vane assembly and a portion of the support member of the second fluke and vane assembly extends into the arcuate notch in the support member of the first fluke and vane assembly, and wherein when the first and second fluke and vane assemblies are pivotably coupled to the first and second shanks and the first and second shanks are hingedly coupled together by the rod, wherein outer ends of the rod are configured to contact the vanes to limit rotation of the first and second fluke and vane assemblies relative to the first and second shanks.

21. A collapsible anchor, comprising:

a first shank;

a second shank configured to be detachably coupled to the first shank;

at least one fluke configured to be hingedly coupled to the first and second shanks, the fluke configured to move between a stowed position and a deployed position;

a first vane configured to be hingedly coupled to the first shank;

a second vane configured to be hingedly coupled to the second shank; and at least one stop configured to limit rotation of the first and second vanes relative to the first and second shanks, wherein when the first and second vanes and the at least one fluke are hingedly coupled to the first and second shanks, the first vane extends in a first direction and the second vane extends in a second direction different than the first direction, wherein when the first and second shanks are coupled together, the first and second shanks together define a keyhole opening, and wherein the at least one stop extends into an arcuate portion of the keyhole opening and is configured to engage ends of the arcuate portion of the keyhole opening to limit rotation of the first and second vanes relative to the first and second shanks.

22. A collapsible anchor, comprising:

a first shank;

a second shank configured to be detachably coupled to the first shank;

at least one fluke configured to be hingedly coupled to the first and second shanks, the fluke configured to move between a stowed position and a deployed position;

a first vane configured to be hingedly coupled to the first shank;

a second vane configured to be hingedly coupled to the second shank;

a sleeve configured to couple upper end portions of the first and second shanks together; and at least one stop configured to limit rotation of the first and second vanes relative to the first and second shanks, wherein when the first and second vanes and the at least one fluke are hingedly coupled to the first and second shanks, the first vane extends in a first direction and the second vane extends in a second direction different than the first direction.

* * * * *